US009814961B2

(12) United States Patent
Kim

(10) Patent No.: US 9,814,961 B2
(45) Date of Patent: Nov. 14, 2017

(54) COLLAPSIBLE SNOWSHOES AND METHODS THEREOF

(71) Applicant: Alite Designs, Inc., San Francisco, CA (US)

(72) Inventor: Tae Wan Kim, San Francisco, CA (US)

(73) Assignee: Alite Designs, Inc., San Francisco, CA (US)

( * ) Notice: Subject to any disclaimer, the term of this patent is extended or adjusted under 35 U.S.C. 154(b) by 0 days.

(21) Appl. No.: 14/812,921

(22) Filed: Jul. 29, 2015

(65) Prior Publication Data

US 2016/0038823 A1 Feb. 11, 2016

Related U.S. Application Data

(60) Provisional application No. 62/034,033, filed on Aug. 6, 2014.

(51) Int. Cl.

| | |
|---|---|
| ***A43B 5/04*** | (2006.01) |
| ***A63C 13/00*** | (2006.01) |
| ***A43B 5/18*** | (2006.01) |
| ***A43C 15/06*** | (2006.01) |

(52) U.S. Cl.

CPC ..... *A63C 13/005* (2013.01); *A43B 5/18* (2013.01); *A43C 15/06* (2013.01); *A63C 2203/10* (2013.01)

(58) Field of Classification Search

CPC ..... A63C 13/005; A43B 5/18
USPC ..... 36/123
See application file for complete search history.

(56) References Cited

U.S. PATENT DOCUMENTS

| | | | | | |
|---|---|---|---|---|---|
| 3,555,707 | A | | 1/1971 | Sharratt et al. | |
| 3,599,352 | A | | 8/1971 | Novak et al. | |
| 4,348,823 | A | * | 9/1982 | Knapp | A63C 13/005 36/123 |
| 4,720,927 | A | * | 1/1988 | Abegg | A63C 13/001 36/122 |
| 4,745,692 | A | | 5/1988 | Liao | |
| 5,459,950 | A | * | 10/1995 | Damm | A63C 13/006 36/122 |
| 5,542,197 | A | * | 8/1996 | Vincent | A43B 5/0419 36/122 |
| 5,740,621 | A | * | 4/1998 | Wing | A63C 13/001 36/122 |
| 5,829,173 | A | * | 11/1998 | Svetlik | A43C 15/06 36/122 |
| 5,901,471 | A | | 5/1999 | Warner | |

(Continued)

OTHER PUBLICATIONS

ISA/U.S., "The International Search Report and Written Opinion", for PCT application No. PCT/US15/43348, dated Nov. 27, 2015, 10 pages.

*Primary Examiner* — Ted Kavanaugh
(74) *Attorney, Agent, or Firm* — Kang S. Lim

(57) ABSTRACT

The present invention relates to collapsible snowshoes. In one embodiment, a collapsible snowshoe includes a collapsible frame, a webbing and a binding. The collapsible snowshoe frame includes a first pair of bars, a second pair of bars, a pair of joints and a center bar securing the pair of joints to each other. The second pair of bars are each collapsible and include bar sections that are removably coupled to each other. The pair of joints is coupled to the corresponding first end of each of the first pair of bars, and is also coupled to the corresponding first end of each of the second pair of bars.

17 Claims, 30 Drawing Sheets

(56) References Cited

U.S. PATENT DOCUMENTS

| | | | |
|---|---|---|---|
| 6,256,908 | B1 | 7/2001 | Warner |
| 7,331,129 | B1 | 2/2008 | Chapman et al. |
| 8,006,412 | B2 | 8/2011 | Kreutzer et al. |
| 2003/0052473 | A1 | 3/2003 | Perkins et al. |

* cited by examiner

COLLAPSIBLE SNOWSHOES AND METHODS THEREOF

CROSS REFERENCE TO RELATED APPLICATIONS

This non-provisional application claims the benefit and is a Continuation-in-Part of provisional application No. 62/034,033, filed Aug. 6, 2014, which application is incorporated herein in its entirety by this reference.

BACKGROUND

The present invention relates to systems and methods for portable snow footwear. In particular, the invention relates to portable, lightweight and collapsible stable snowshoes.

Modern conventional snowshoes are made from newer synthetic materials and, therefore, are lighter than older conventional wooden-framed snowshoes. However, these newer snowshoes are still somewhat bulky and hence for space utility reasons are often attached to the exterior of backpacks when not in use.

Thus, there is an urgent need in the cold-weather backpacking field to create new, useful, portable, stable and collapsible snowshoes. These improved collapsible snowshoes have to be strong, durable and lightweight, and well suited for use on rugged terrain often encountered outdoors in cold weather.

SUMMARY

To achieve the foregoing and in accordance with the present invention, systems and methods for constructing collapsible snowshoes are provided.

In one embodiment, a collapsible snowshoe comprises a collapsible frame, a webbing and a shoe binding configured to secure a user's footwear. The collapsible snowshoe frame includes a first pair of bars, a second pair of bars, a pair of joints and a center bar. Each of the first and second pair of bars has a first end and a second end. The second pair of bars are each collapsible and include at least two bar sections that are configured to be removably coupled to each other. The pair of joints are configured to be coupled to the corresponding first end of each of the first pair of bars, and further configured to be coupled to the corresponding first end of each of the second pair of bars. The center bar is configured to securely couple the pair of joints to each other.

The webbing includes a pair of front frame interface elements configured to accommodate the corresponding second end of each of the first pair of bars, and also includes a rear frame interface element configured to accommodate the corresponding second ends of the second pair of bars. In this embodiment, the front frame interface elements and the rear frame element are pockets.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute and/or sequential terms, such as, for example, "will," "will not," "shall," "shall not," "must," "always," "must not," "first," "initially," "next," "subsequently," "before," "after," "lastly," and "finally," are not meant to limit the scope of the present invention as the embodiments disclosed herein are merely exemplary.

The present invention relates to systems and methods for constructing portable, lightweight and collapsible stable snowshoes well suited for cold weather hiking and backpacking. To facilitate discussion, FIGS. 1A-8B illustrate several exemplary embodiments of collapsible snowshoes in accordance to the present invention.

I. Collapsible Snowshoe Embodiments

Figure 1A:
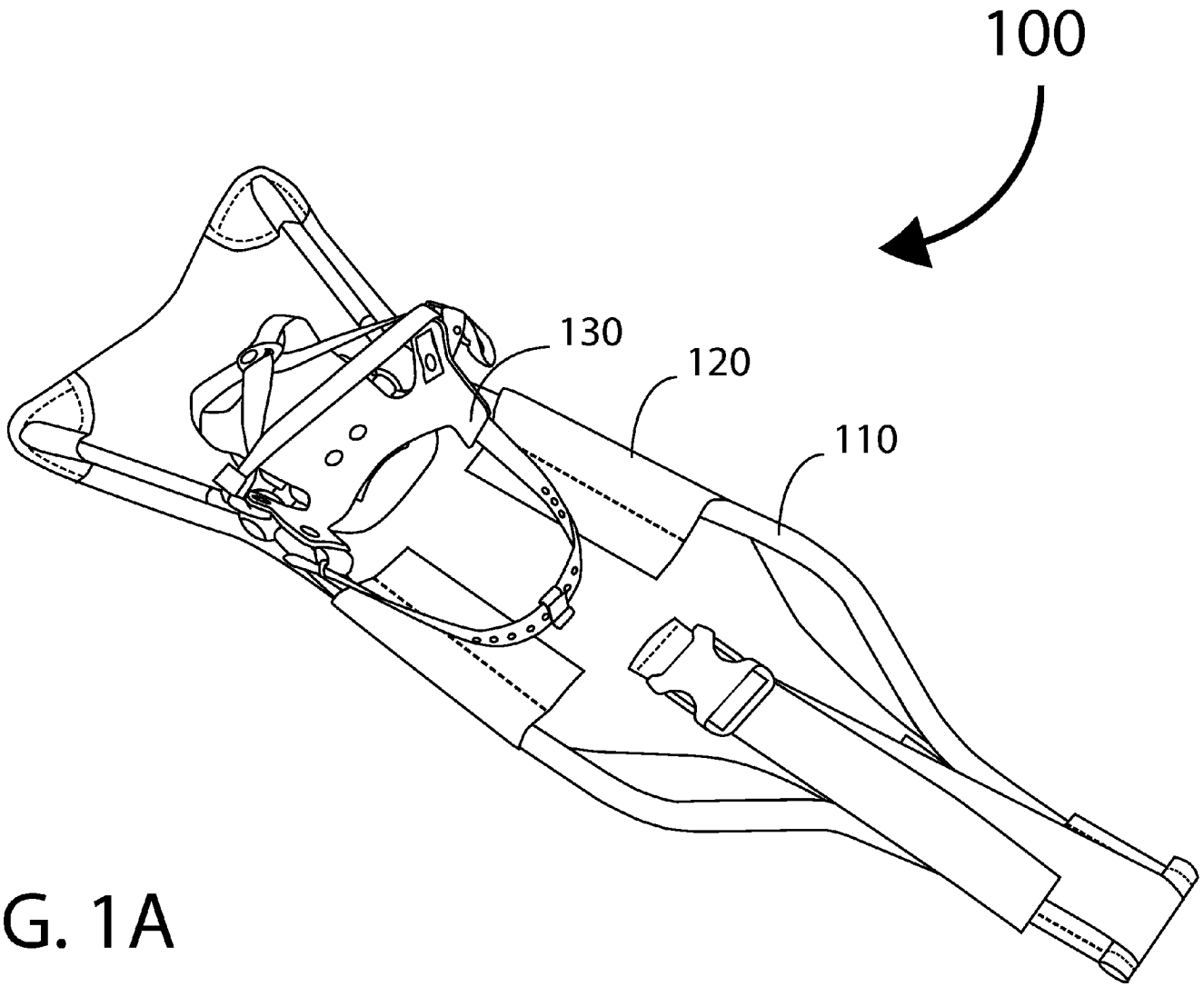
FIGS. 1A-1C illustrate embodiments of collapsible snowshoes in accordance with the present invention.
Figure 1B:
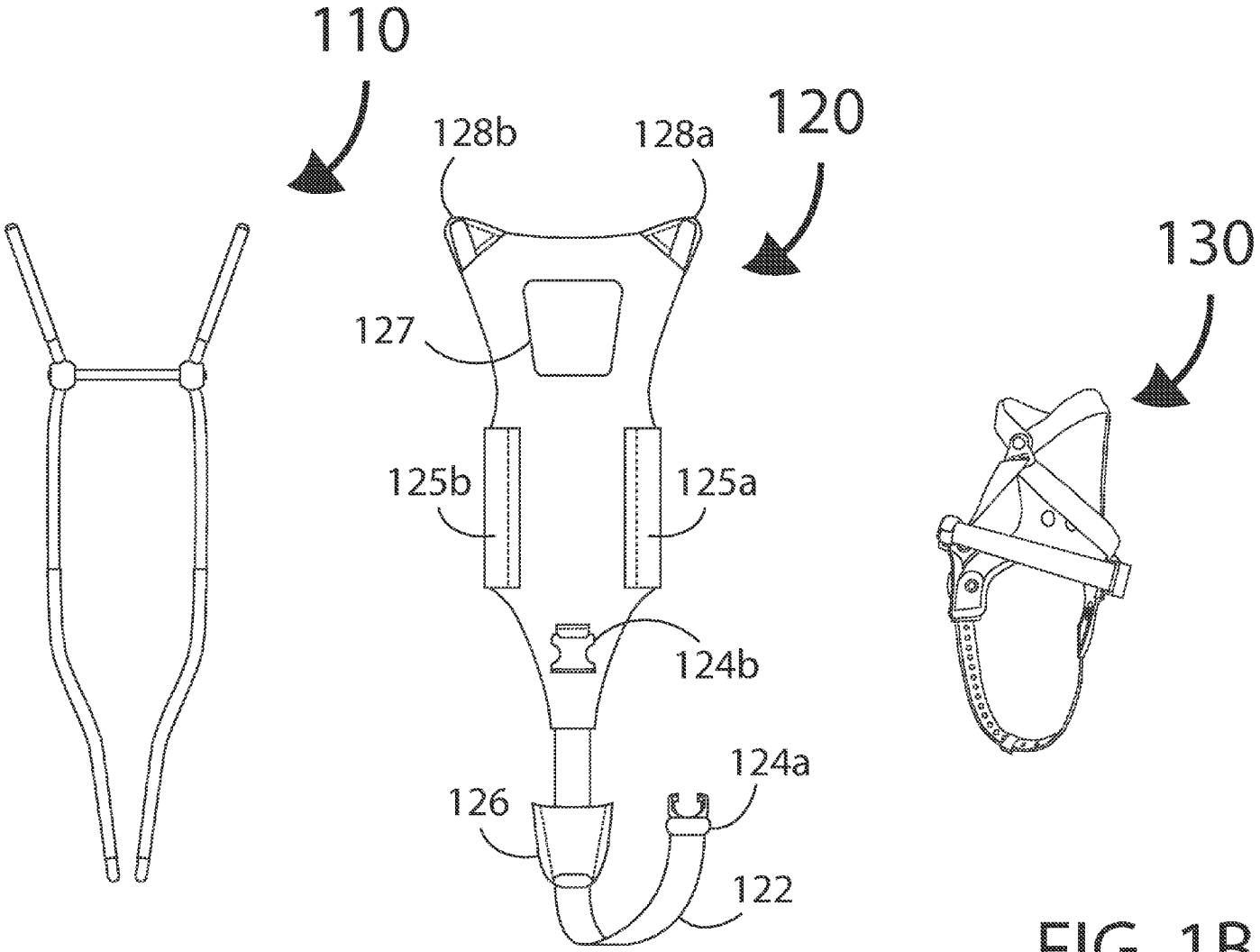
Figure 1C:
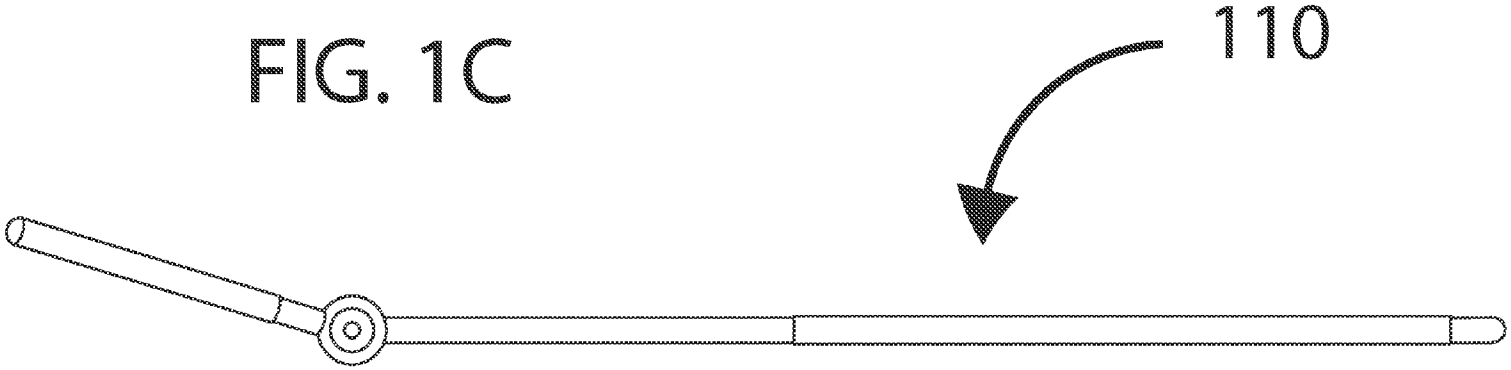
Figure 1D:
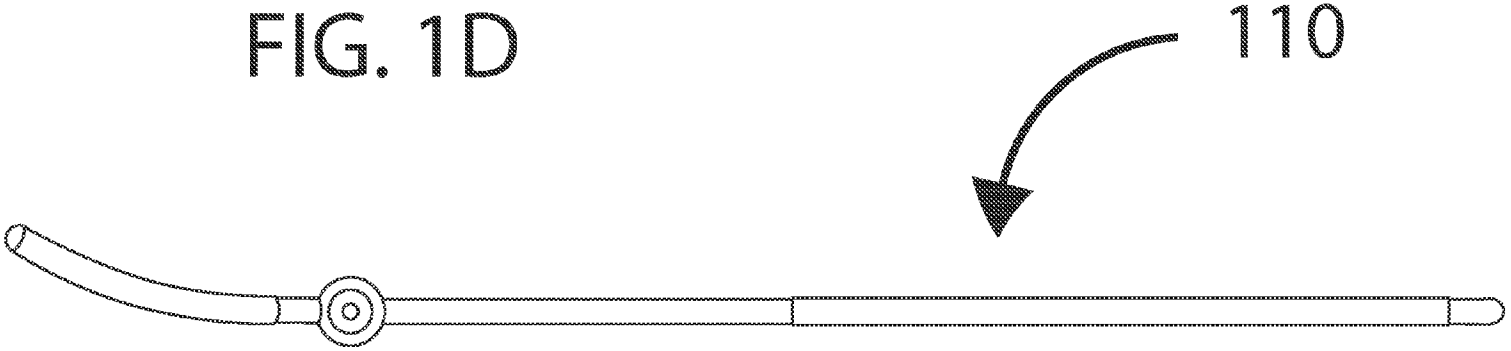
FIG. 1D is a side view showing a frame variation for the embodiments illustrated by FIG. 1A.

FIGS. 1A-1C are a perspective view, an exploded view and a side view, respectively, illustrating one embodiment of a snowshoe 100 for travelling on snow fields. Snowshoe 100 includes a collapsible frame 110, a flexible webbing 120 and a shoe binding 130, coupled to each other to provide a substantially larger footprint for a suitable footwear such as a hiking boot (not shown). FIG. 1D is a side view of an alternate embodiment for snowshoe frame 110.

Webbing 120 includes front frame interface elements 128*a* & 128*b*, side sleeves 125*a* & 125*b*, mating fasteners 124*a* & 124*b*, a rear strap 122 and a rear frame interface element 126.

The frame interface elements 128*a*, 128*b* and/or 126 may be machined, injection molded, or manufactured in any suitable fashion, and can also be made from metal, plastic, polycarbonate, or any other suitable material. In another variation, frame interface elements 128*a*, 128*b* and/or 126 are grommets or washers coupled to or sewn into the webbing 110 that slide over or otherwise couple to the respective ends of the collapsible frame 110.

In this embodiment, the frame interface elements 128*a*, 128*b* and 126 are pockets that are coupled to or sewn into the webbing 120 that slide over or otherwise couple to the respective ends of the collapsible frame 110. Hence, when assembled, front pockets 128*a* & 128*b* securely accommodate the respective front ends of frame 110, while the rear pocket 126 accommodates the rear ends of frame 110.

Mating fasteners 124*a* & 124*b* can be, for example, a quick release buckle set shown in FIG. 1B. Fasteners 124*a* & 124*b* further secures the webbing 120 to the frame 110.

Webbing 120 can also include an opening 127 thereby creating an optional window for accommodating snowshoe binding 130 with optional spikes and/or shoes (not shown) that may be configured with crampons to provide additional traction in packed snow commonly found in well-travelled trails or on icy trails. Webbing 120 can be made from one or more of a wide variety of natural, synthetic and/or blended materials including nylon, neoprene, Kevlar, and animal hides.

Figure 2A:
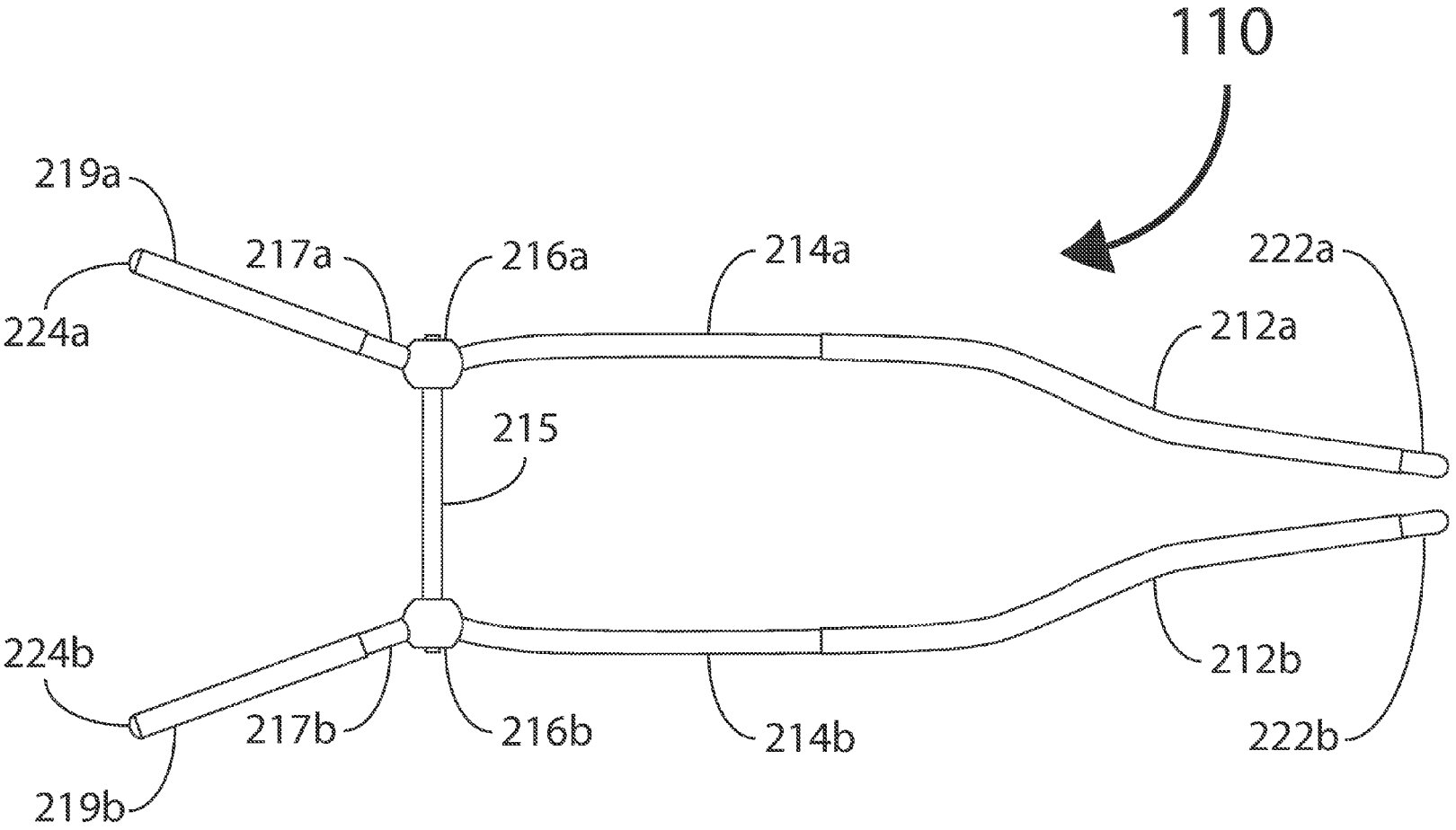
FIGS. 2A-2C further illustrate frame collapsibility for the embodiments of FIG. 1A.
Figure 2B:
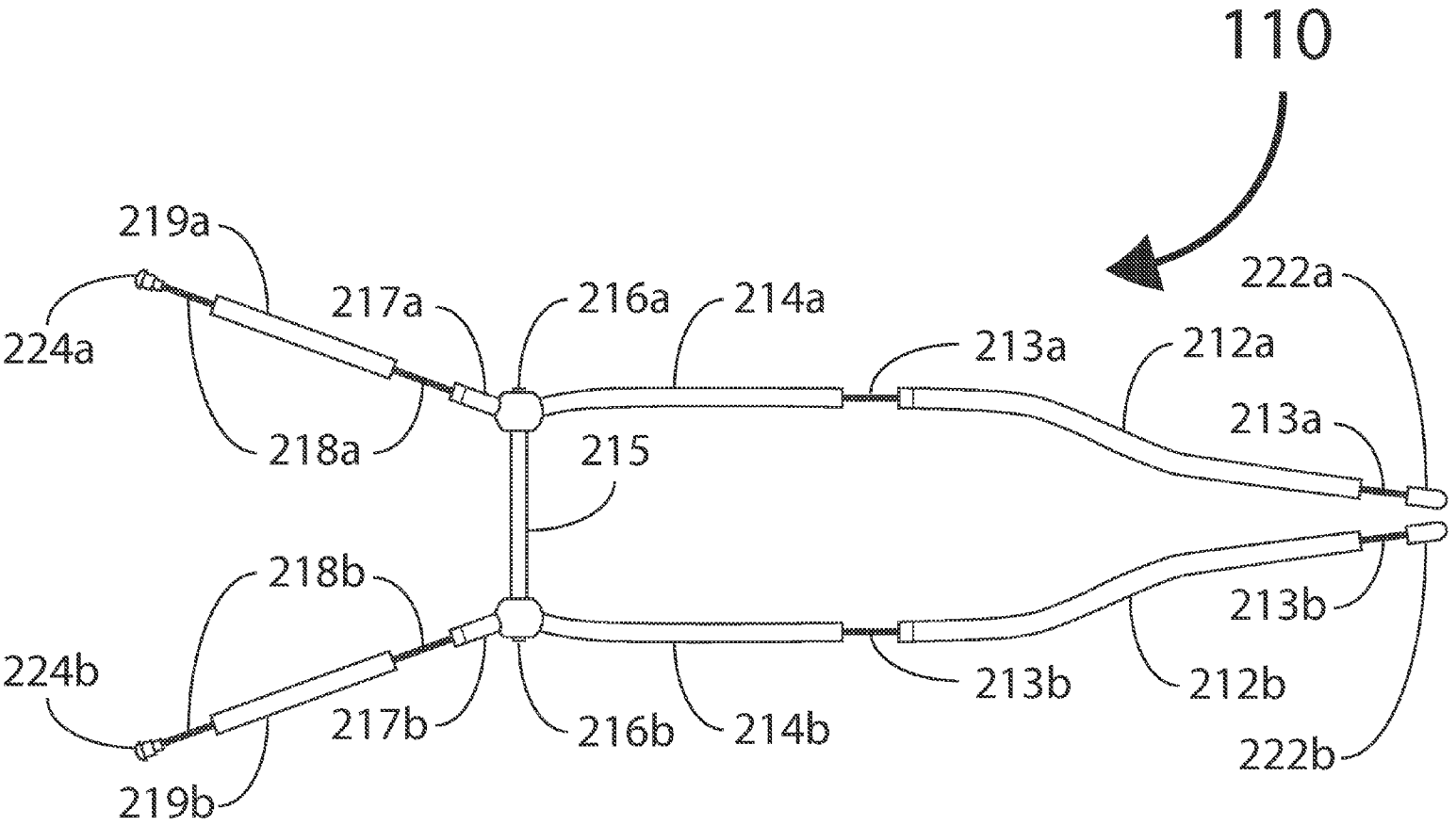
Figure 2C:
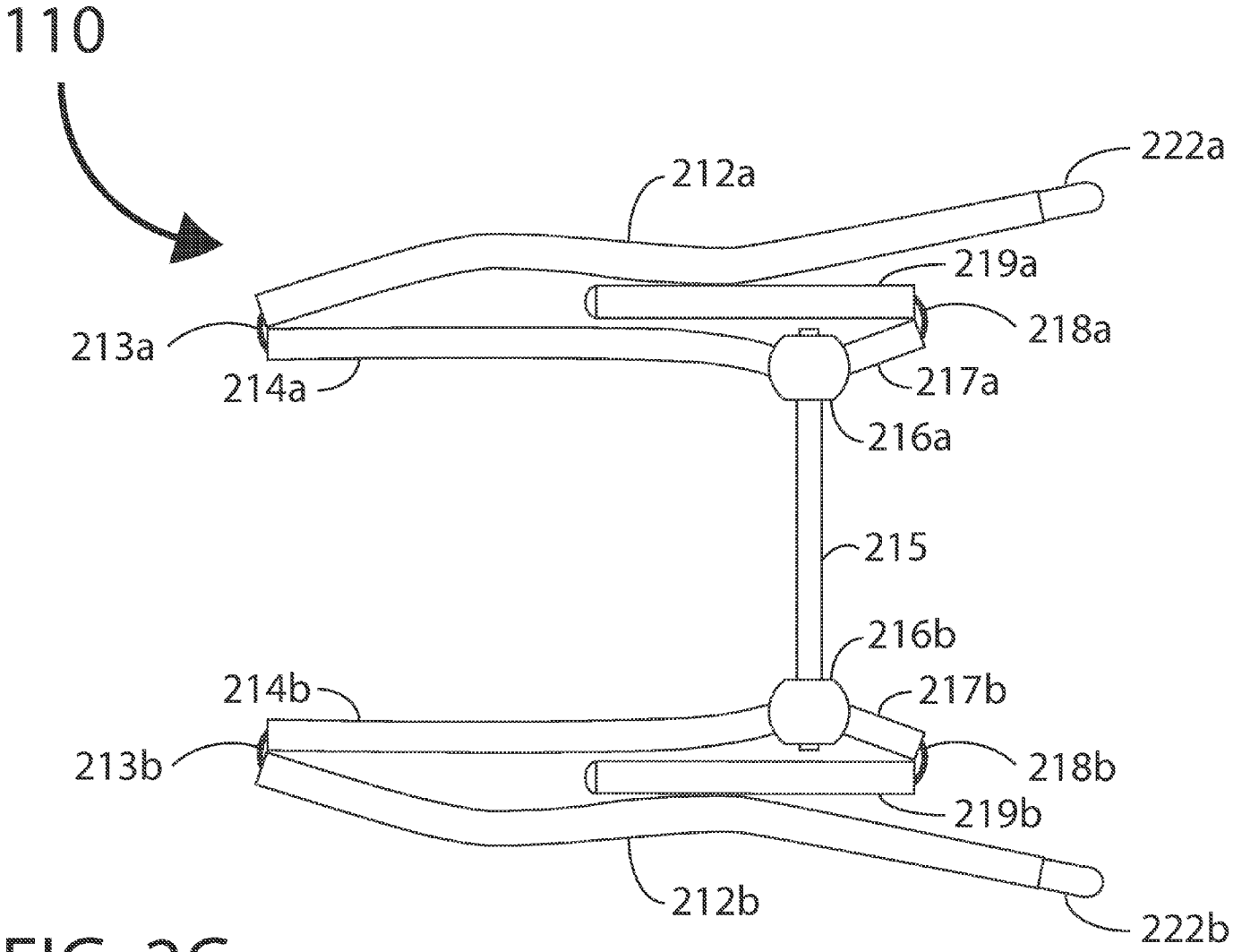
Figure 3A:
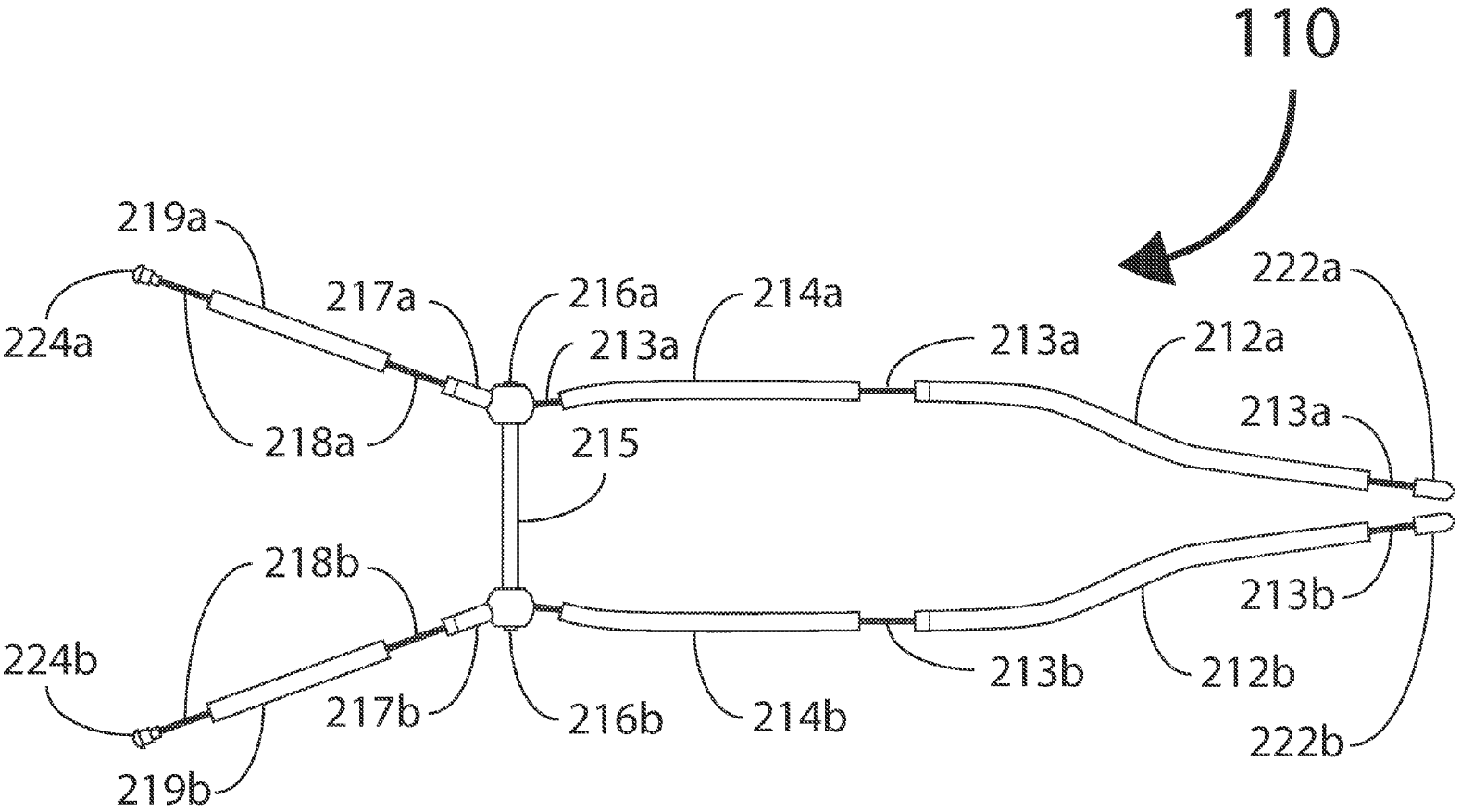
FIGS. 3A-4B show additional frame collapsibility configurations for the embodiments exemplified in FIG. 1A.
Figure 3B:
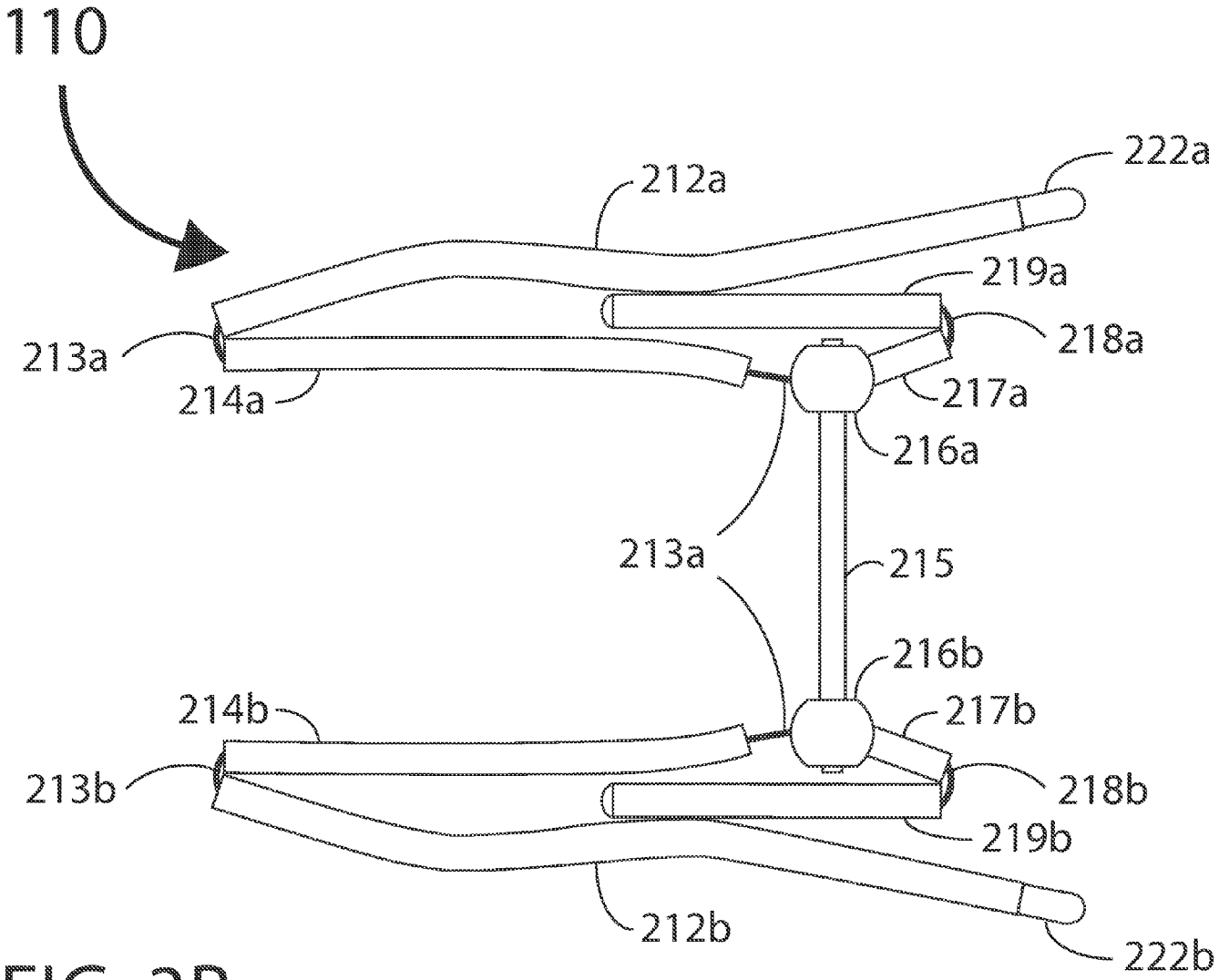
Figure 4A:
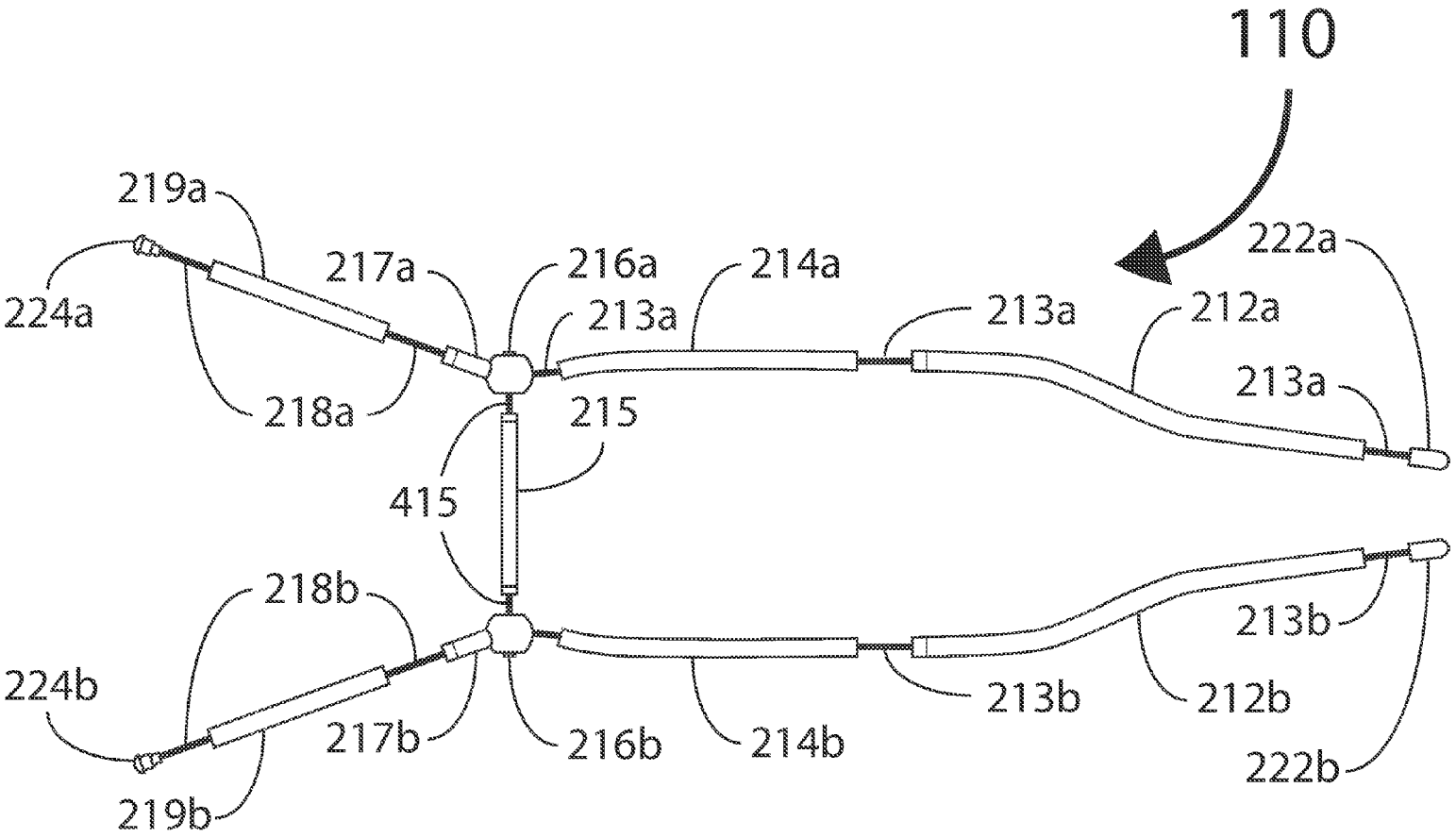
Figure 4B:
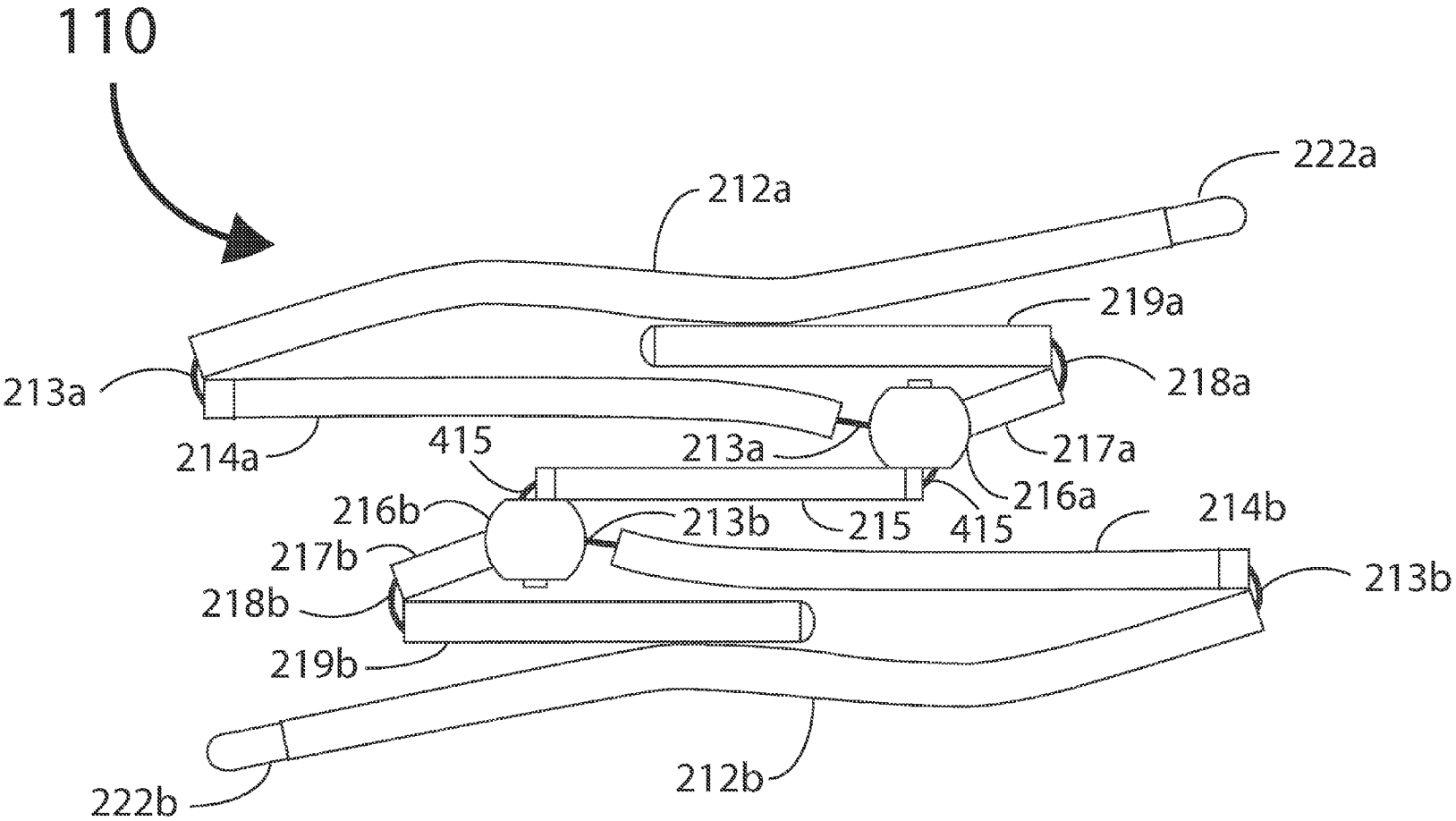

Referring now to FIGS. 2A & 2B, frame 110 is now described in greater detail. Frame 110 includes end caps 224*a* & 224*b*, front bars 219*a* & 219*b*, joint extensions 217*a* & 217*b*, joints 216*a* & 216*b*, center bar 215, rear bar pairs 214*a* & 212*a* and 214*a* & 212*b*, and end caps 222*a* & 222*b*. FIG. 2C illustrates how collapsible frame 110 can be compactly folded for ease of travel, e.g., for backpacking Front bars 217*a*, 217*b* can be removably coupled to joints 216*a*, 216*b*, via elastic cords 218*a*, 218*b* attached to end caps 224*a* & 224*b* and through joint extensions 217*a*, 217*b*, respectively. In addition, rear bar pairs 214*a* & 212*a* can be removably coupled to joint 216*a* via elastic cord 213*a* attached to end cap 222*a*. Similarly, rear bar pairs 214*b* & 212*b* can be removably coupled to joint 216*b* via elastic cord 213*b* attached to end cap 222*b*.

FIGS. 3A & 3B and FIGS. 4A & 4B illustrate additional alternate collapsibility configurations between joints 216*a* & 216*b* and respective bars 214*a*, 214*b* & 215. For example, in FIGS. 4A & 4B, center bar 215 is detachable coupled to joints 216*a*, 216*b* via elastic cord 415.

Note that in the various described embodiments, elastic cords, e.g., cords 213*a*, 213*b*, 218*a*, 218*b*, and 415 can be a single cord or combination of several jointed cords. For example, cords 213*a* and 218*a* can be formed from a single continuous cord. It is also possible to combine several strands of thinner cords into a single stronger cord. Elastic cords of frame 110 can be made from a suitable strong and stretchable material such as rubber or Bungee.

The bars forming exemplary frame 110 of the described embodiments function to support webbing 120 and hence the weight of a user. Accordingly, the bars can be one of several suitable variations. In most embodiments, the bars are cylindrical rods, but may alternatively have any suitable geometry and may have varying geometries along the length of the rods. The bars are straight or linear bars, but may alternatively be curved, bent, or have any other suitable geometry. The bars can be made of metal (such as 0.433" 7075 T9 aluminum poles with approximately 0.030" wall thickness), or plastic, but may be alternatively made from any suitable material, such as titanium, carbon fiber and/or fiberglass. The bars are collapsible or foldable such that they include multiple sections that can be assembled to support the sling and the weight of the user and can be disassembled for easy transportation and storage. Each of the sections are straight, but may alternatively be curved or angled. Each section may have the same radius of curvature or angle, but alternatively each section may have a different radius of curvature or angle.

Figure 9:
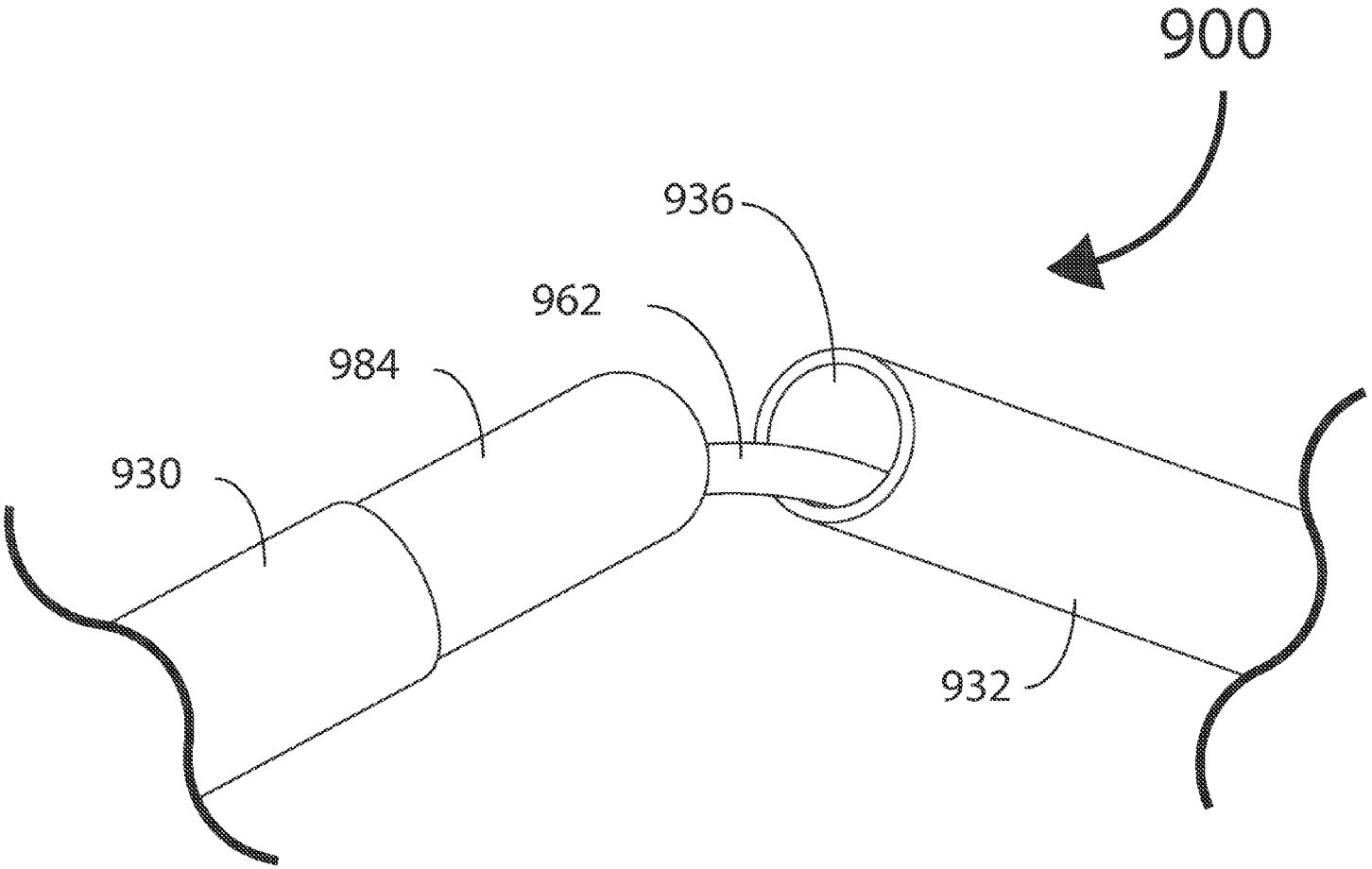
FIG. 9 illustrates a collapsible bar for the snowshoe embodiment of FIG. 1A.

FIG. 9 further illustrates collapsible bars for exemplary frame 110, with each collapsible bar including two or more bar sections. In some embodiments, collapsible bar 900 includes a first bar section 930 and a second bar section 932 removably coupled to the first bar section 930. The first bar section 930 has an end portion with an outer diameter dimension 984 and the second bar section 932 has an end portion that defines a recess 936 that receives the outer diameter dimension 984 of the end portion of the first bar section 930. The outer diameter dimension 984 has a diameter less than the outer diameter of the collapsible bar 900. For example, the bar 932 may have approximately 0.370" outer diameter while the bar 930 has an outer diameter 984 of approximately 0.433". The end portion of the first bar section 930 may be a separate piece that is coupled to the first bar section 930. For example, the separate piece may have an outer diameter of approximately 0.433" with approximately 0.040" wall thickness. Alternatively, the first bar section may couple to the second bar section in any other suitable fashion. The first bar section 930 is substantially identical to the second bar section 932, but alternatively, the first bar section 930 and the second bar section 932 may have different geometries, dimensions, and/or cross sections.

II. Assembly of Collapsible Snowshoe Embodiments

Referring back to FIGS. 1A-1B and 2A-2B, after the frame 110 is assembled and secured be elastic cords 213*a*, 213*b*, 218*a* & 218*b*, the frame rear ends 222*a*, 222*b* are inserted into side sleeves 215*a*, 215*b*, respectively. The frame front ends 224*a*, 224*b* are then inserted into webbing front pockets 128*a*, 128*b*, respectively. Frame rear ends 222*a*, 222*b* are then inserted into webbing rear packet 126.

Note that rear strap 122 is threaded and slides freely through a slot of rear pocket 126. Bucket set 124*a*, 124*b* are securely coupled to each other and strap 122 is snugly tightened, thereby completing the assembly of snowshoe 100.

As discussed above, shoe binding 130 can be secured to frame 110 and/or webbing 120. Binding 130 can be coupled to, for example, center bar 215, by employing one or more of a variety of suitable techniques, including but not limited to, straps, buckles, grommets, buttons, snaps, hook-and-loop, adhesives and/or mechanical couplers such as clamps, latches and straps.

III. Additional Collapsible Snowshoe Embodiments

Figure 5A:
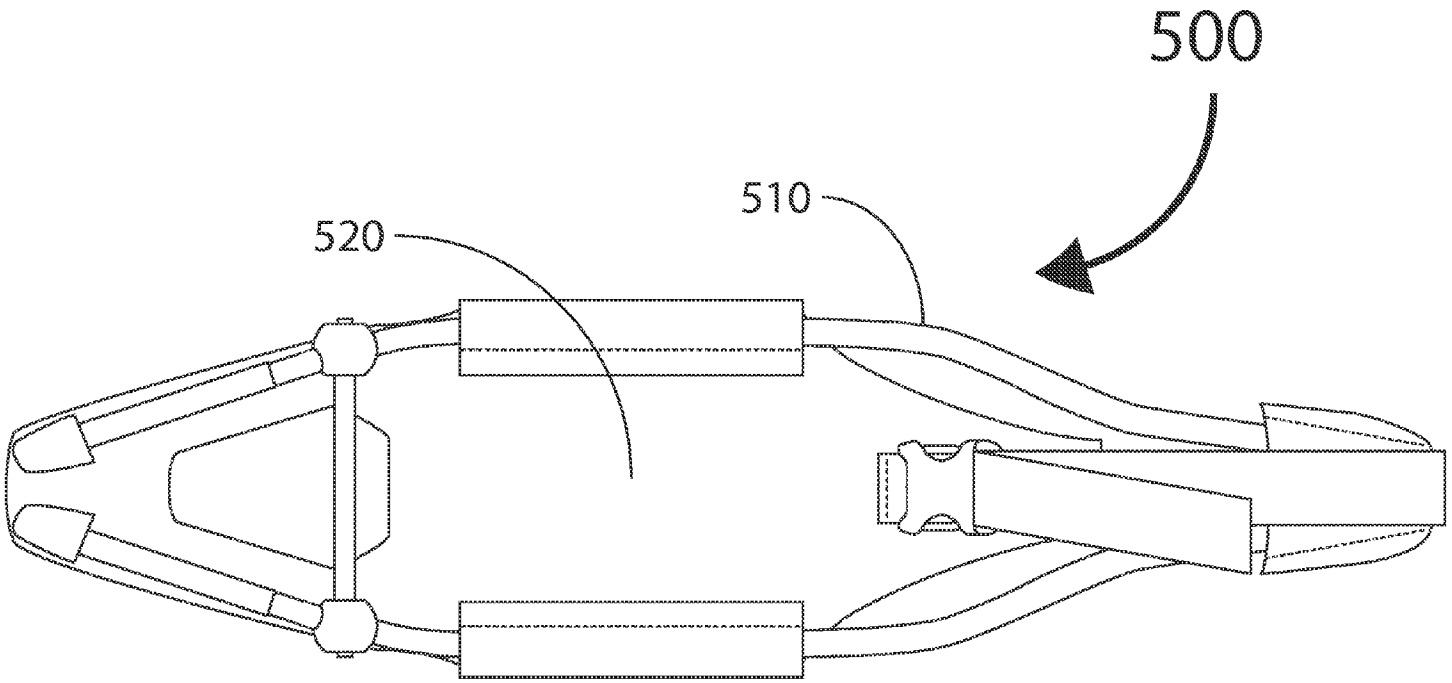
FIGS. 5A-7B illustrate additional embodiments of snowshoes in accordance to the present invention.
Figure 5B:
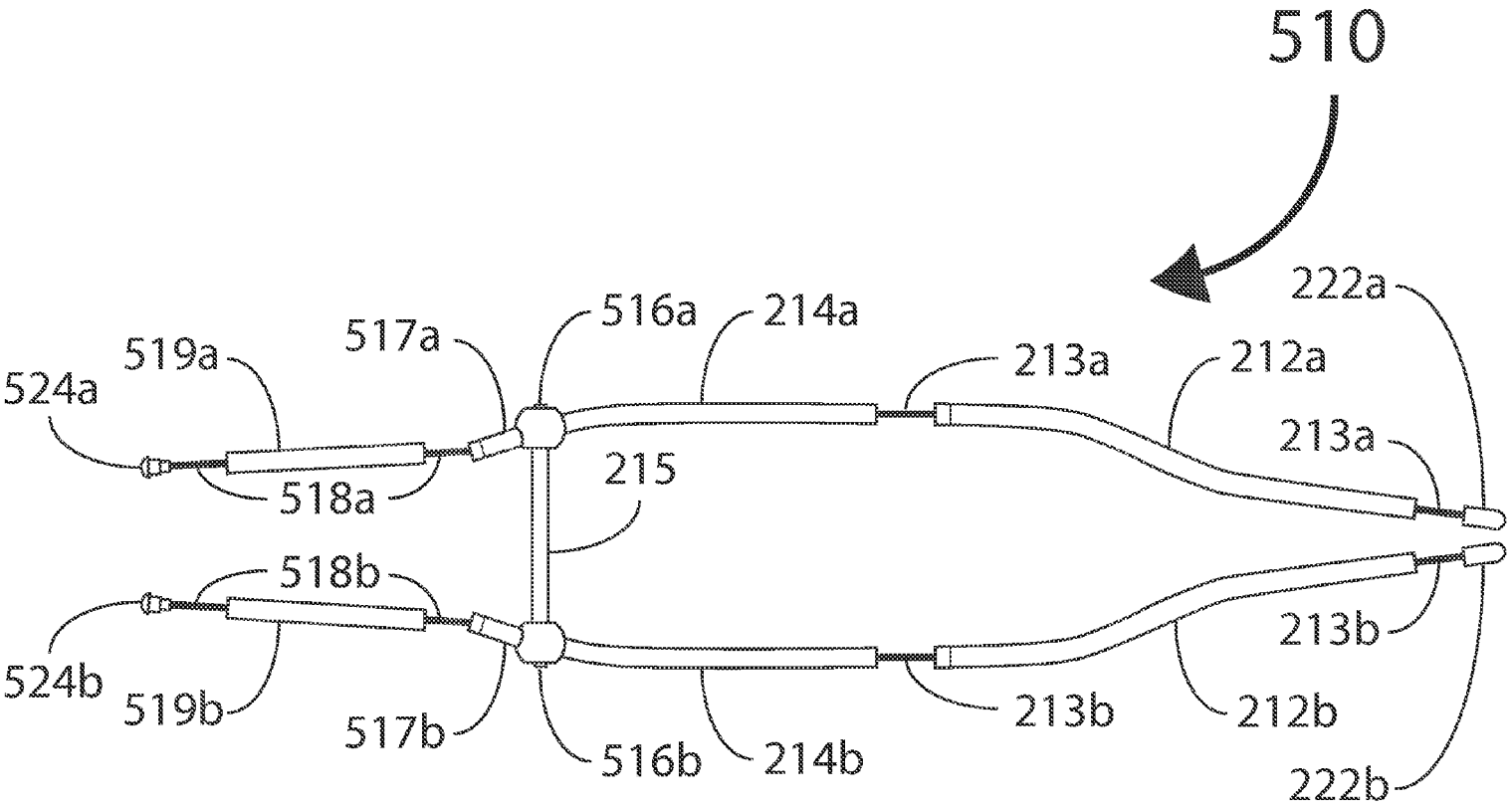
Figure 6A:
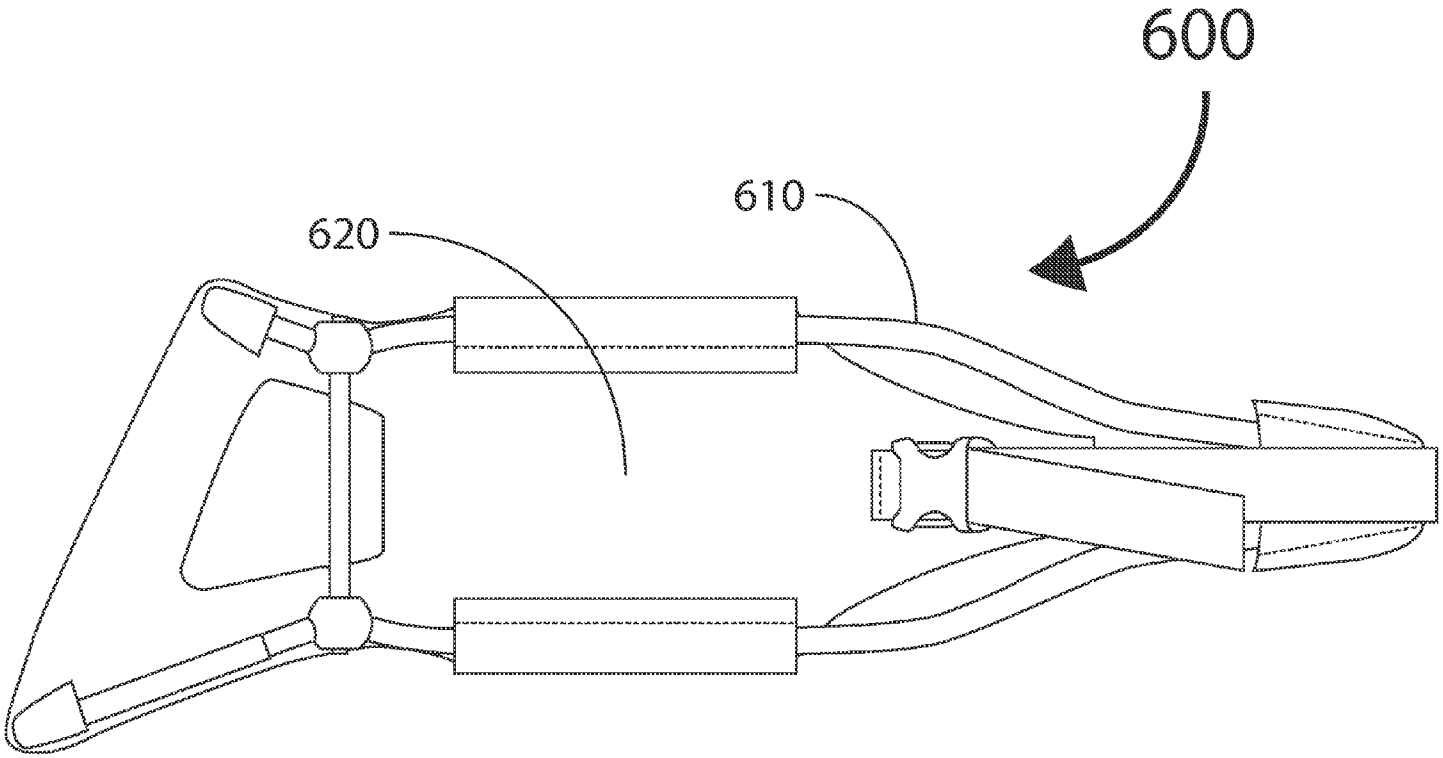
Figure 6B:
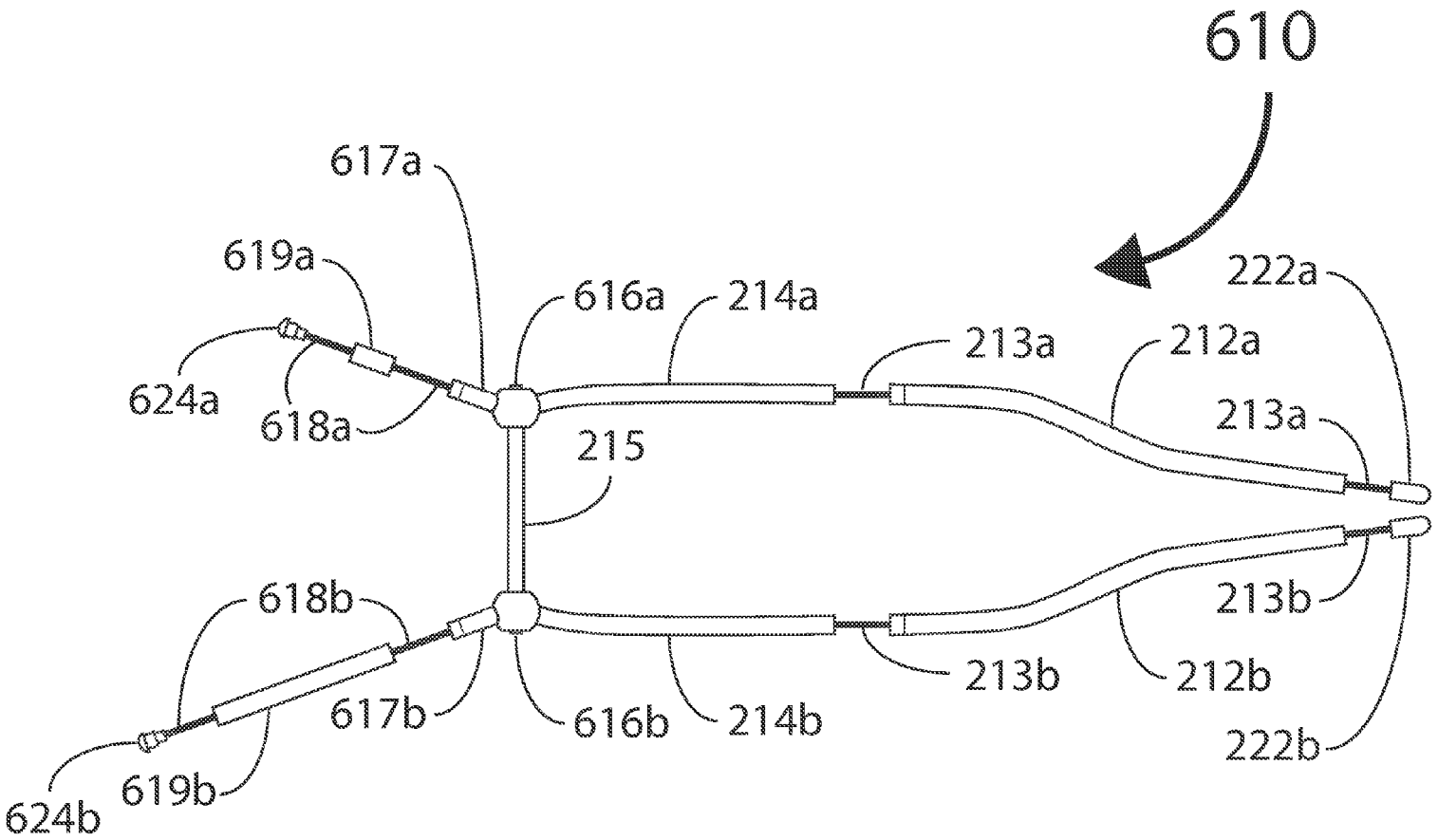
Figure 7A:
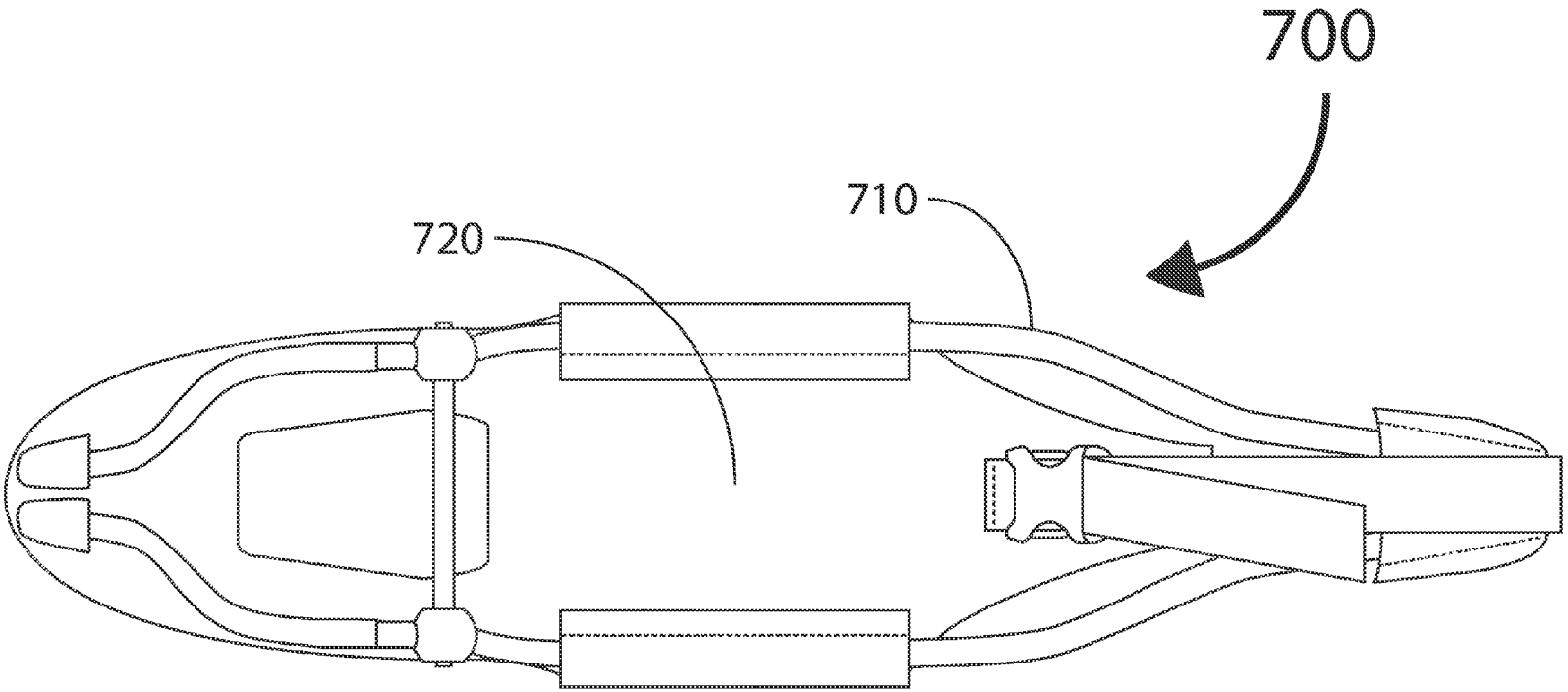
Figure 7B:
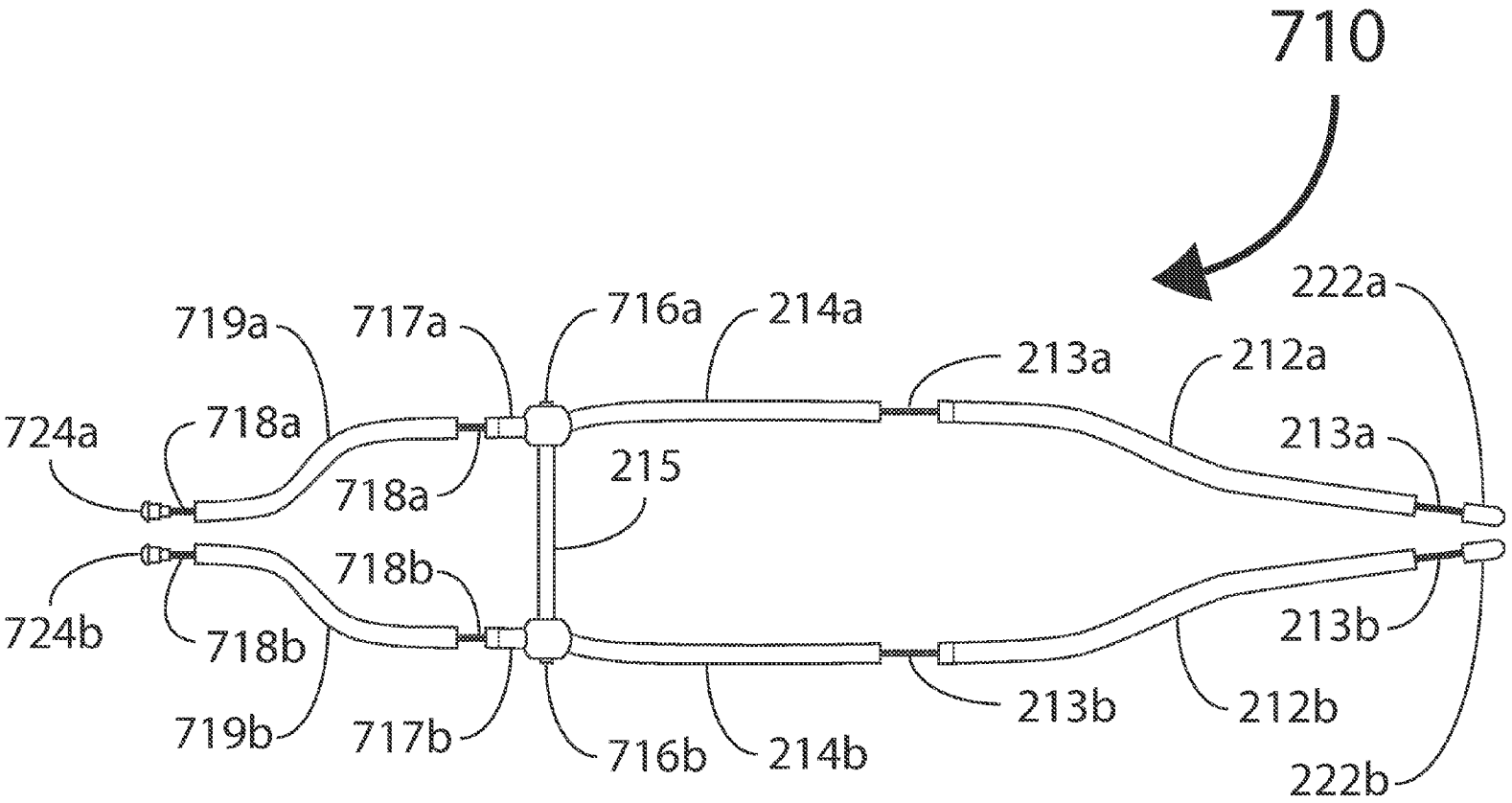

FIGS. 5A-7B illustrates additional embodiments of snowshoe 500, snowshoe 600 and snowshoe 700 have different front bar configurations in accordance to the present invention. For example, FIGS. 5A & 5B illustrate snowshoe 500 having front bars 519*a*, 519*b* having front ends pointing substantially inwards. FIGS. 6A & 6B illustrate snowshoe 600 with asymmetrical front bars 619*a*, 619*b*, while FIGS. 7A & 7B illustrate a snowshoe 700 have curved front bars 719*a*, 719*b*.

Figure 8A:
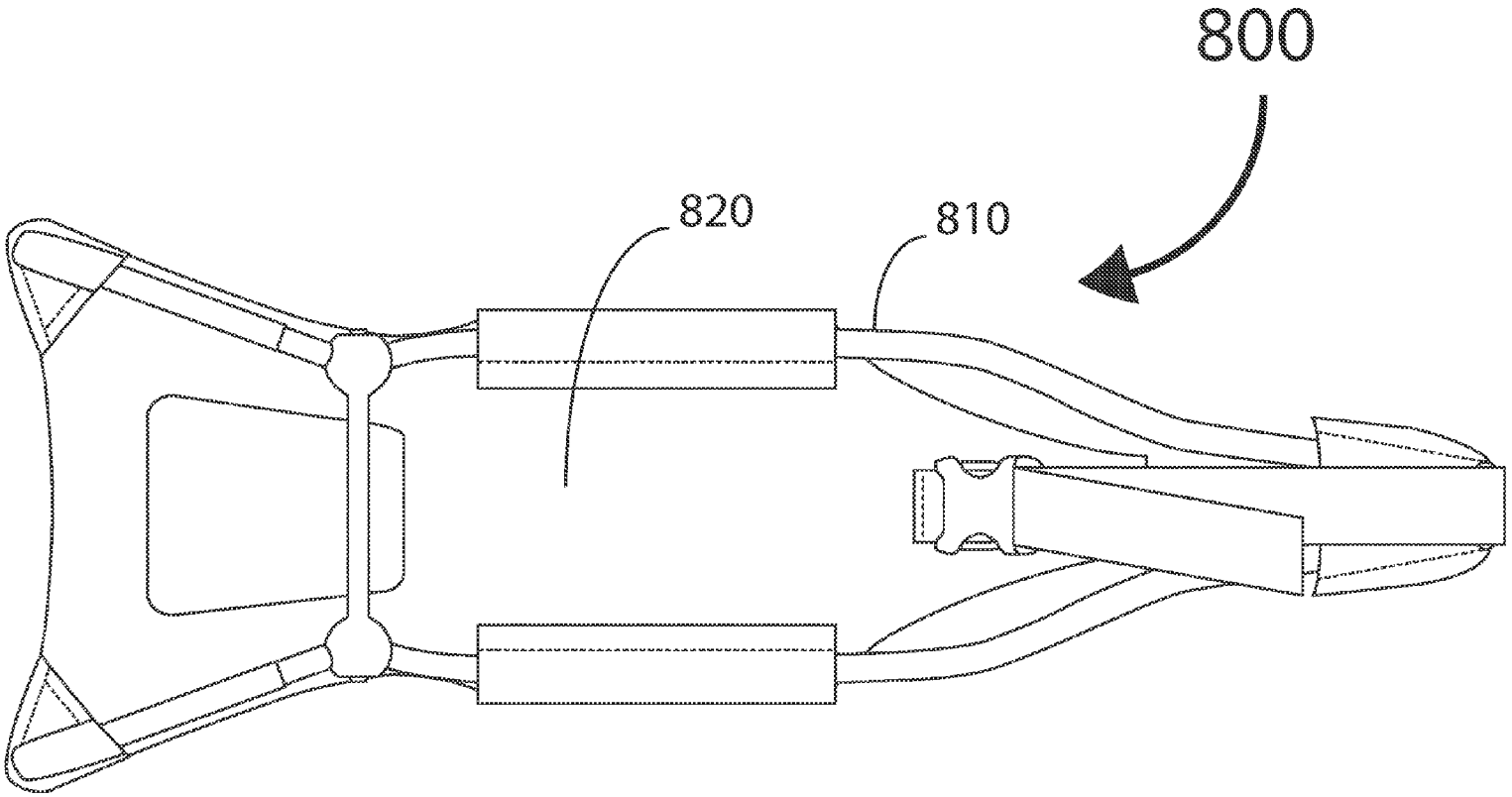
FIGS. 8A-8B are top views illustrating yet another embodiment of a snowshoe in accordance with the present invention.
Figure 8B:
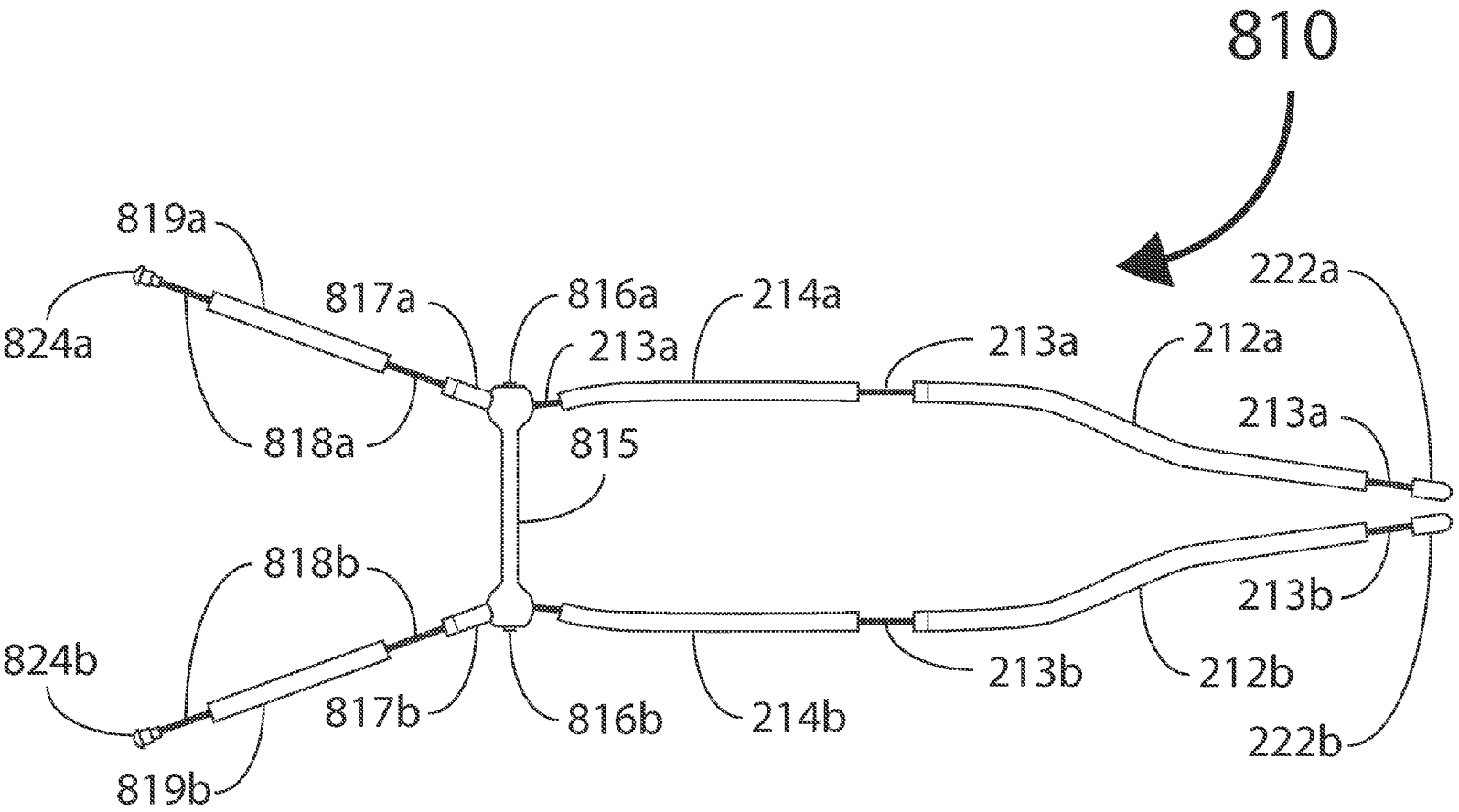

In yet another embodiment, snowshoe 800 as shown in FIGS. 8A-8B, joints 816*a* & 816*b* are integrated into a center bar 815, thereby increasing the stability and strength of such a combination. Depending on the implementation, center bar 815 may be solid or hollow. In addition, center bar 815 can have a variety of suitable cross-sectional profiles such as circular, oval, "D", "I" and "U".

FIGS. 11A-11C and 12A-12D, respectively, illustrate two additional variations of snowshoes 1100 and 1200 wherein the respective front bars are coupled to each other to form stable frame front ends for snowshoe frames 1110 and 1210.

Figure 11A:
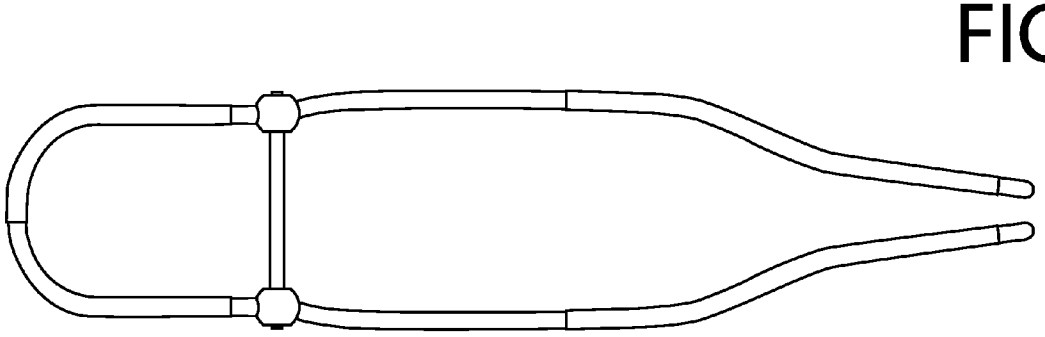
FIGS. 11A-11C and 12A-12D, respectively, illustrate two additional snowshoe variations of the embodiment of FIG. 7A.
Figure 11B:
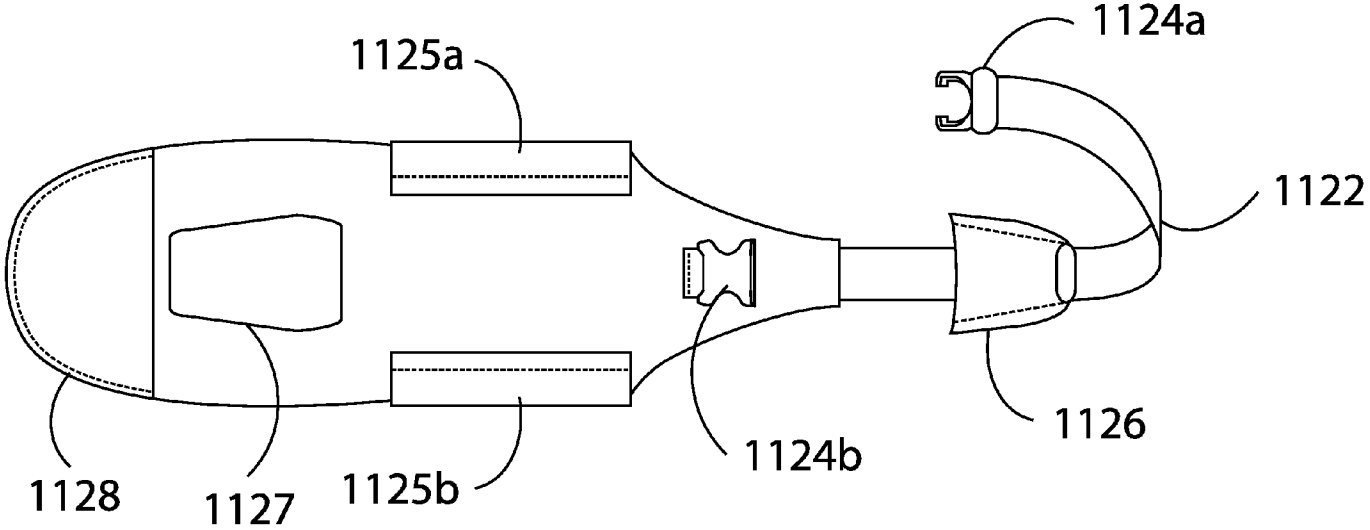
Figure 11C:
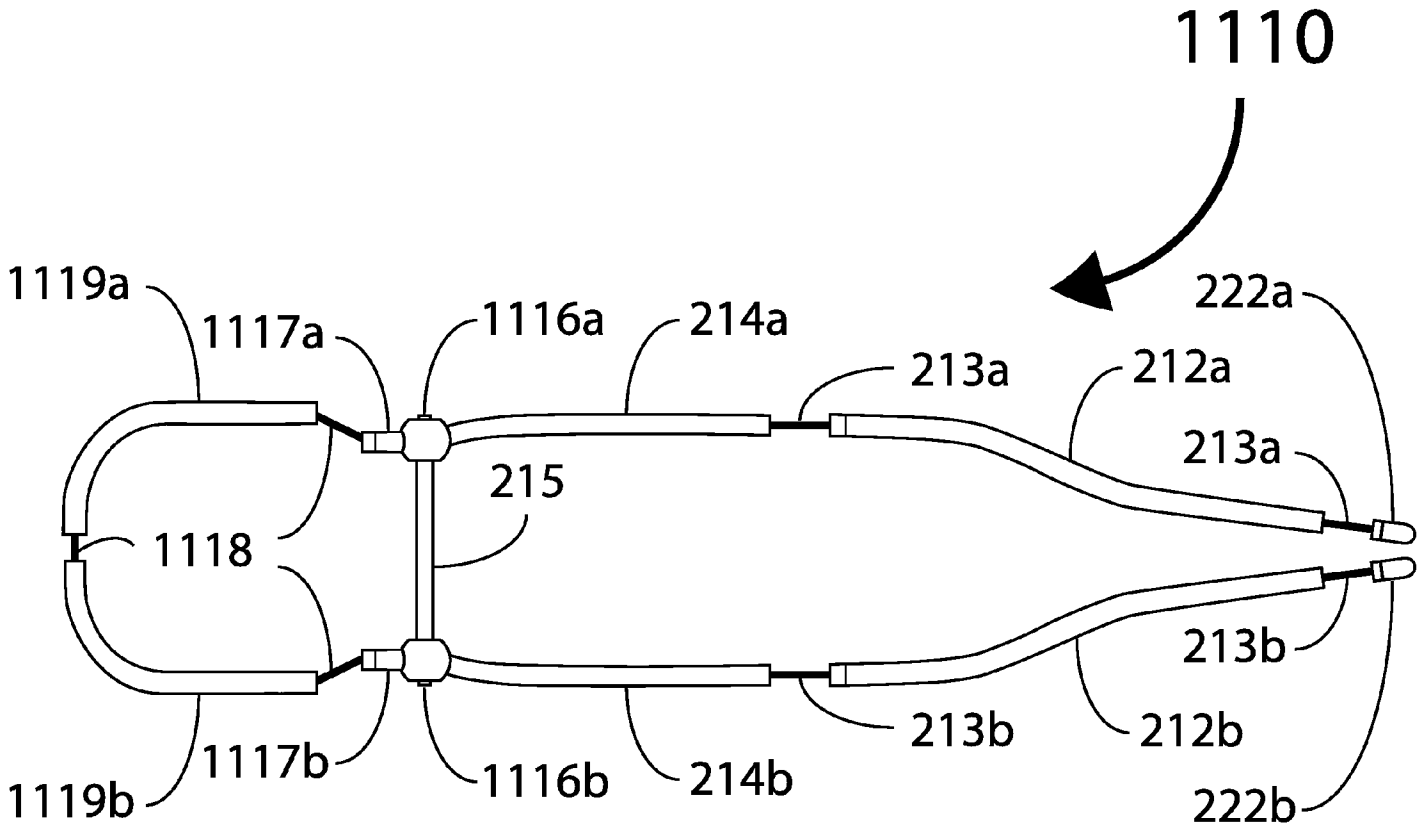

As shown in FIGS. 11A and 11C, snowshoe frame 1110 includes a front bar 1119*a* configured to be inserted in a corresponding front bar 1119*b*, and securely coupled to each other by front elastic cord 1118. Frame 1110 also includes rear bar pairs 212*a*, 214*a* and 212*b*, 214*b* configured to be inserted into webbing side sleeves 1125*a* and 1125*b*, respectively.

In this embodiment, front bars 1119*a*, 1119*b* can be removably coupled to joints 1116*a*, 1116*b*, via elastic cord 1118 and through joint extensions 1117*a*, 1117*b*, respectively. In addition, rear bar pairs 214*a* & 212*a* can be removably coupled to joint 216*a* via elastic cord 213*a* attached to end cap 222*a*. Similarly, rear bar pairs 214*b* & 212*b* can be removably coupled to joint 216*b* via elastic cord 213*b* attached to end cap 222*b*.

The front end of assembled frame 1110 is configured to be inserted into a front pocket 1128 of webbing 1120. The assembled snowshoe 1100 can be secured by a restraining rear strap 1122 by mating buckle set 1124*a*, 1124*b* and tensioning strap 1122 with respect to buckle 1124*a*, 1124*b*, as needed (see FIGS. 11A and 11B).

Alternatively, in shown FIGS. 12A-12D, snowshoe frame 1210 includes front bars 1219*a* & 1219*b* configured to be hinged to each other by an exemplary hinge pin 1219*c*. Frame 1210 also includes rear bar pairs 212*a*, 214*a* and 212*b*, 214*b* configured to be inserted into webbing side sleeves 1125*a* and 1125*b*, respectively.

Figure 12C:
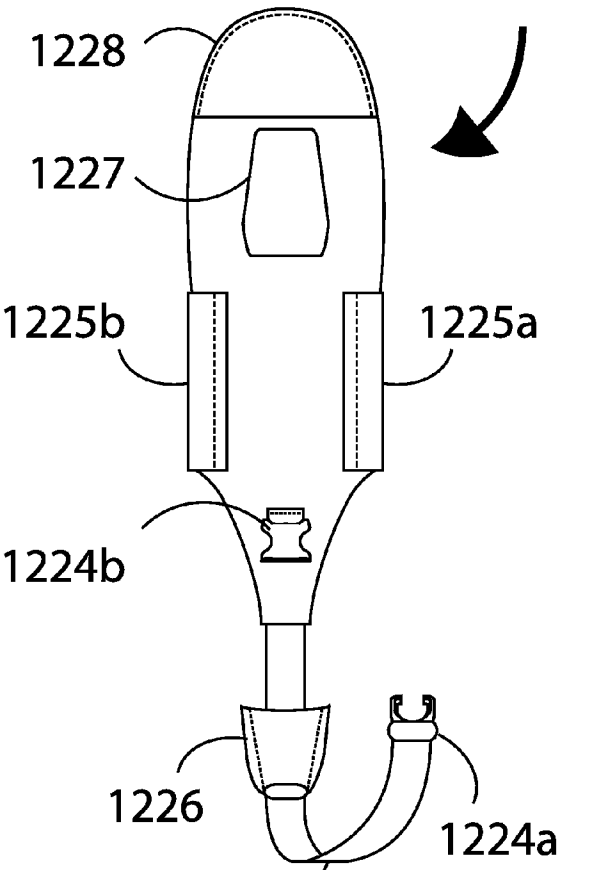
Figure 12B:
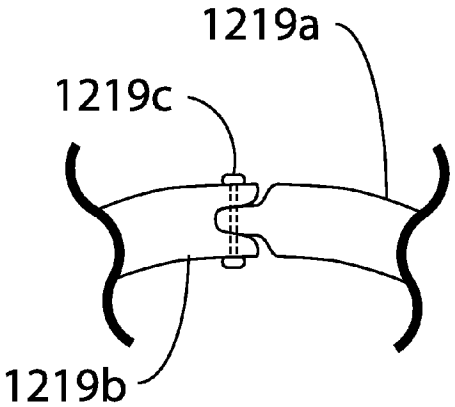
Figure 12A:
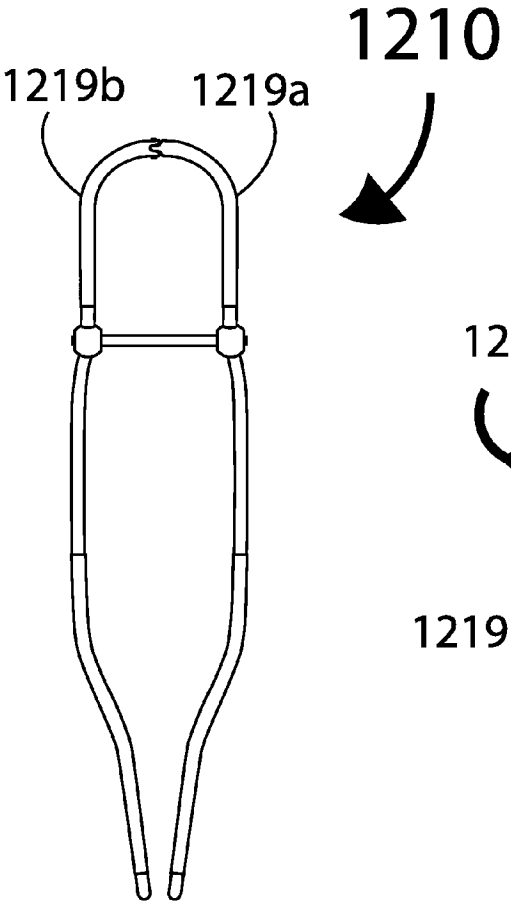
Figure 12D:
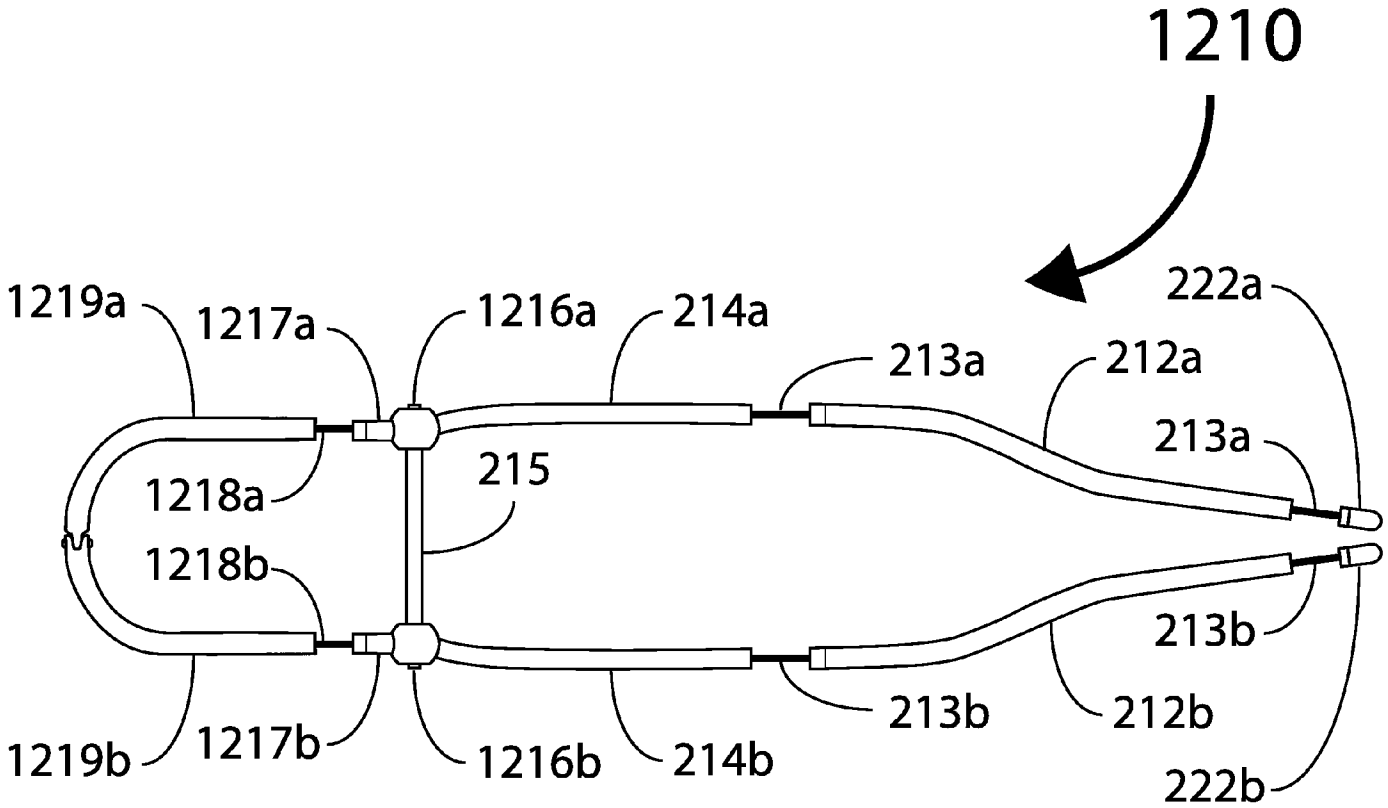

As shown in FIG. 12D, front bars 1219*a*, 1219*b* can be removably coupled to joints 1216*a*, 1216*b*, via elastic cords 1218*a*, 1218*b* attached through joint extensions 1217*a*, 1217*b*, respectively. In addition, rear bar pairs 214*a* & 212*a* can be removably coupled to joint 216*a* via elastic cord 213*a* attached to end cap 222*a*. Similarly, rear bar pairs 214*b* & 212*b* can be removably coupled to joint 216*b* via elastic cord 213*b* attached to end cap 222*b*.

The front end of frame 1210 is configured to be inserted into a front pocket 1228 of webbing 1220. The assembled snowshoe 1200 can be secured by a rear strap 1222 by mating buckle set 1224*a*, 1224*b* and tightening strap 1222 as needed (see FIGS. 12A and 12C).

Figure 13A:
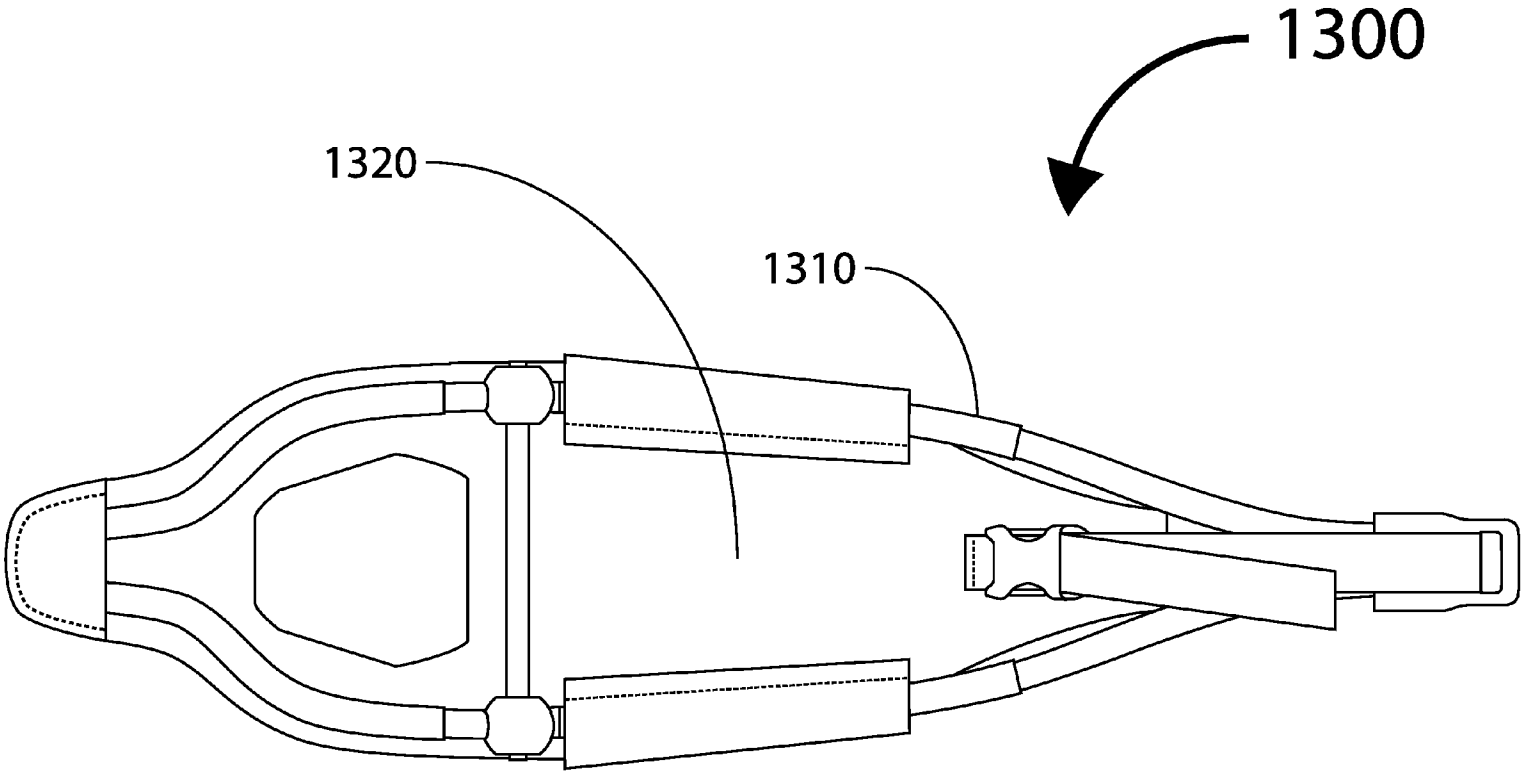
FIG. 13A-13D illustrate yet another exemplary snowshoe embodiment of the snowshoe in accordance with the present invention.
Figure 13B:
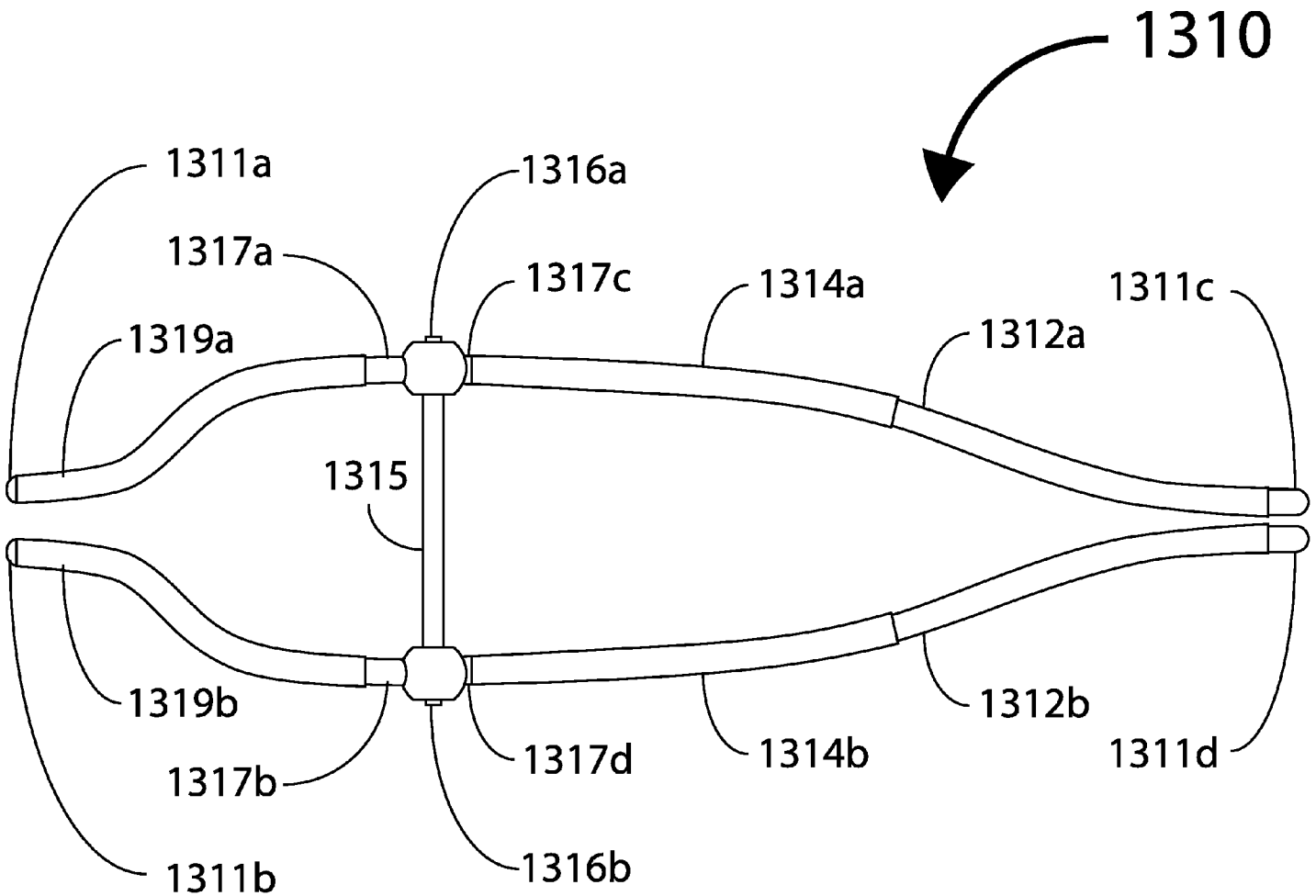
Figure 13C:
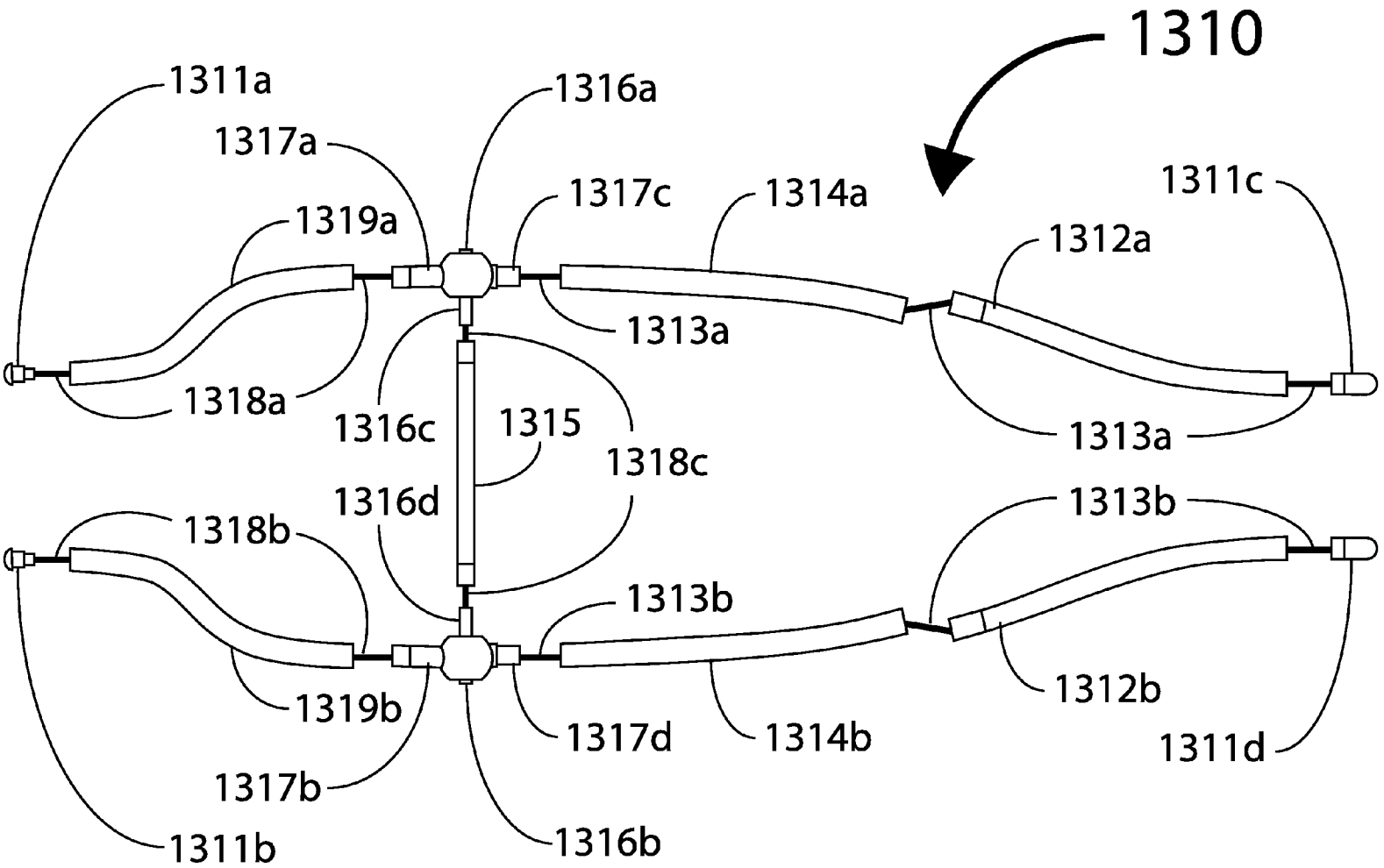
Figure 13D:
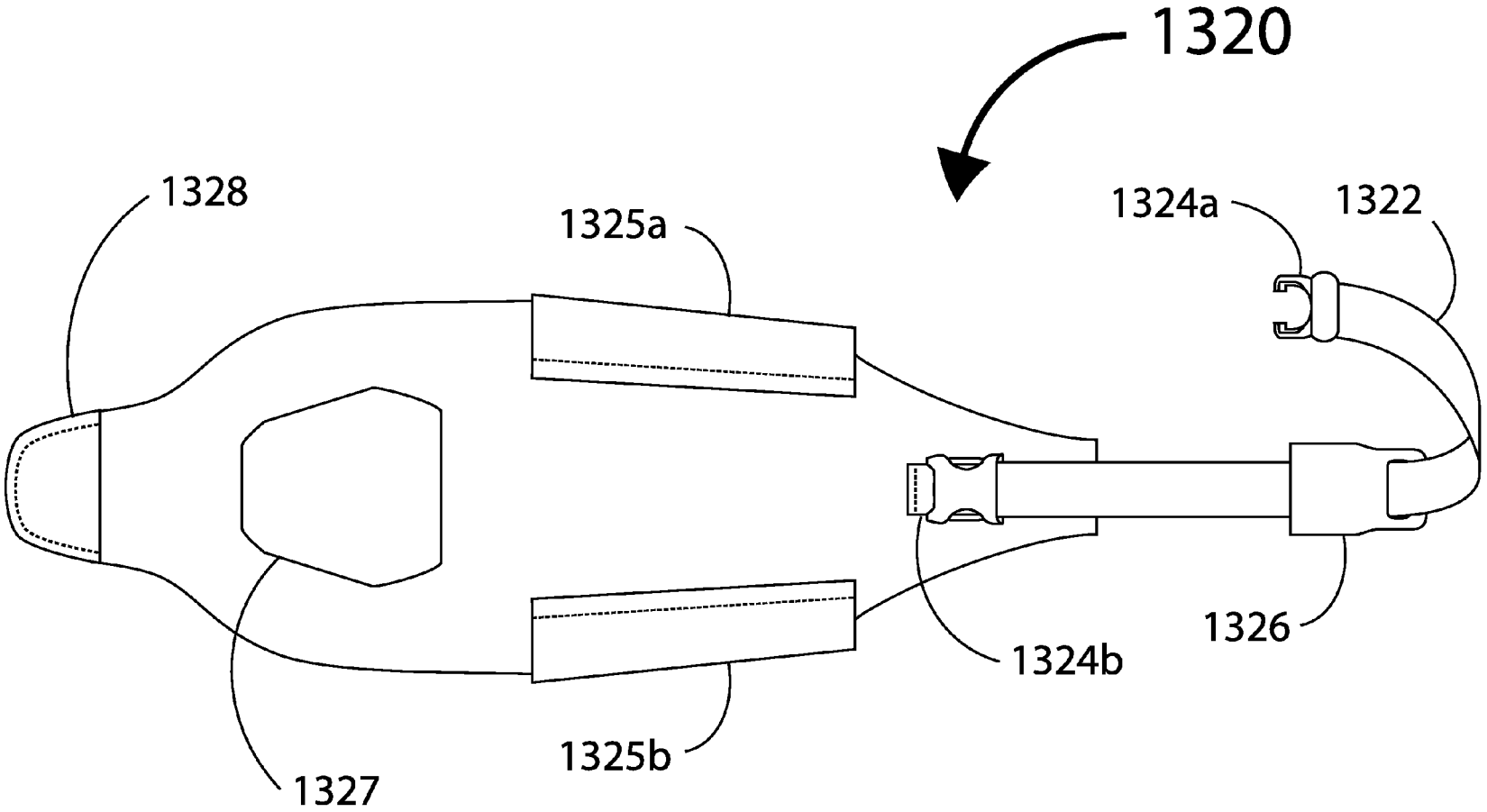

Referring now to FIGS. 13A-13D, an additional embodiment of snowshoe 1300 is illustrated. Snowshoe 1300 includes a collapsible frame 1310, a flexible webbing 1320 and a shoe binding (not shown). FIG. 13A shows an assembled view of snowshoe 1300, while FIG. 13D shows webbing 1320. FIGS. 13B and 13C are assembled view and exploded view, respectively, of frame 1310.

As shown in FIG. 13B, frame 1310 includes end caps 1311*a* & 1311*b*, front bars 1319*a* & 1319*b*, joint extensions 1317*a* & 1317*b*, joints 1316*a* & 1316*b*, center bar 1315, rear bar pairs 1314*a* & 1312*a* and 1314*b* & 1312*b*, and end caps 1311*c* & 1311*d*.

The exploded view of FIG. 13C illustrates front bars 1319*a*, 1319*b* removably coupled to joints 1316*a*, 1316*b*, via elastic cords 1318*a*, 1318*b* attached to end caps 1311*a* & 1311*b* and through joint extensions 1317*a*, 1317*b*, respectively. In addition, rear bar pairs 1314*a* & 1312*a* can be removably coupled to joint 1316*a* via elastic cord 1313*a* attached to end cap 1311*c*. Similarly, rear bar pairs 1314*b* & 1312*b* can be removably coupled to joint 1316*b* via elastic cord 1313*b* attached to end cap 1311*d*.

Referring to FIG. 13D, webbing 1320 includes front frame interface 1328, side sleeves 1325*a* & 1325*b*, mating fasteners 1324*a* & 1324*b*, a rear strap 1322 and a rear frame interface element 1326. The frame interface elements 1328 and/or 1326 may be machined, injection molded, or manufactured in any suitable fashion, and can also be made from metal, plastic, polycarbonate, or any other suitable material. In another variation, frame interface elements 1328 and/or 1326 are grommets or washers coupled to or sewn into the webbing 1310 that slide over or otherwise couple to the respective ends of the collapsible frame 1310.

In this embodiment, frame interfaces 1328 and 1326 can also be pockets that are coupled to or sewn into the webbing 1320 that slide over or otherwise couple to the respective ends of the collapsible frame 1310. Hence, when assembled, front pocket 1328 securely accommodate the front ends of frame 1310, while the rear pocket 1326 accommodates the rear ends of frame 1310.

Webbing 1320 may include an opening 1327 for accommodating a shoe (not shown) configured with crampons to provide additional fraction in packed snow commonly found in well-travelled trails or on icy trails. Webbing 1320 can be made from one or more of a wide variety of natural, synthetic and/or blended materials including nylon, neoprene, Kevlar, and animal hides.

As shown in FIGS. 13A and 13D, mating fasteners 1324*a* & 1324*b* can be, for example, a quick release buckle set. Bucket set 1324*a* & 1324*b* in combination with strap 1322 further secures the webbing 1320 to the frame 1310.

Figure 14:
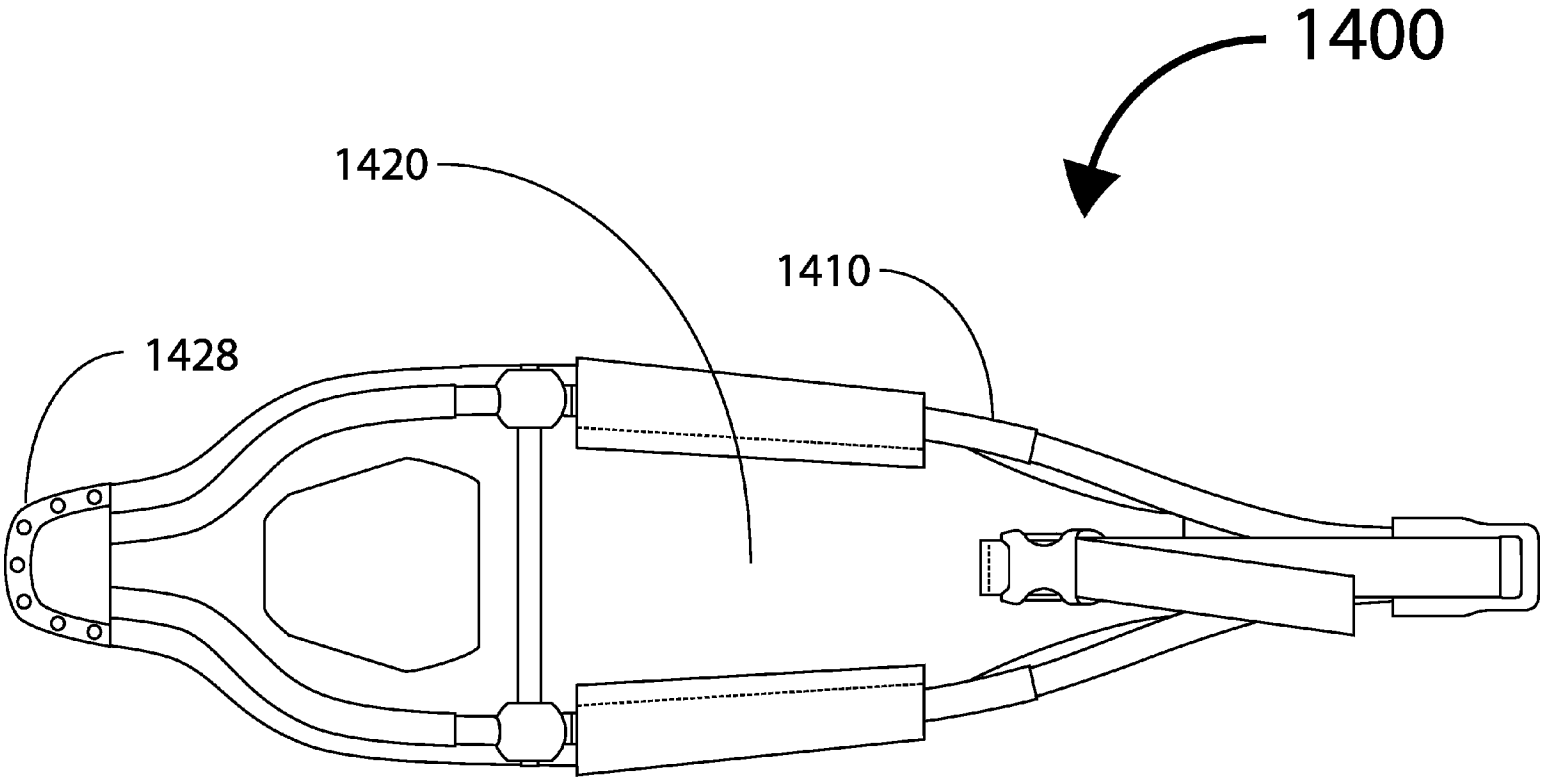
FIGS. 14 and 15A-15B, respectively, illustrate two additional variations of the snowshoe embodiment of FIG. 13A.

Referring to FIG. 14, snowshoe 1400 is a variation of snowshoe 1300, wherein a rigid front pocket 1428, is secured, by for example, riveting and/or adhesive, to webbing 1420. Front pocket 1428 includes a suitably rigid material such as plastic, metal and/or a laminate. Examples of suitable plastics include polycarbonate, thermoplastics such as HDPE, PVC and Kydex™. Examples of metals include aluminum, steel and titanium. Example of laminates include one or more of a layer of wood, bamboo, hemp, carbon fiber and/or fiberglass.

IV. Additions to and Modifications of Collapsible Snowshoes

Many additions and modifications to the exemplary embodiments described above are also contemplated within the scope of the present invention. For example, buckle sets 124*a*, 124*b* and 1124*a*, 1124*b* can be replaced by hook and loop interfaces. Strap 122 may be made from an elastic material.

In addition, center bar 215 may be secured to joints 216*a*, 216*b* without an internal elastic cord. Instead, an optional pair of corresponding ball-and-detent couplers, twist-lock couplers or threaded couplers may be incorporated at the respective ends of center bar 215 (not shown).

Figure 15A:
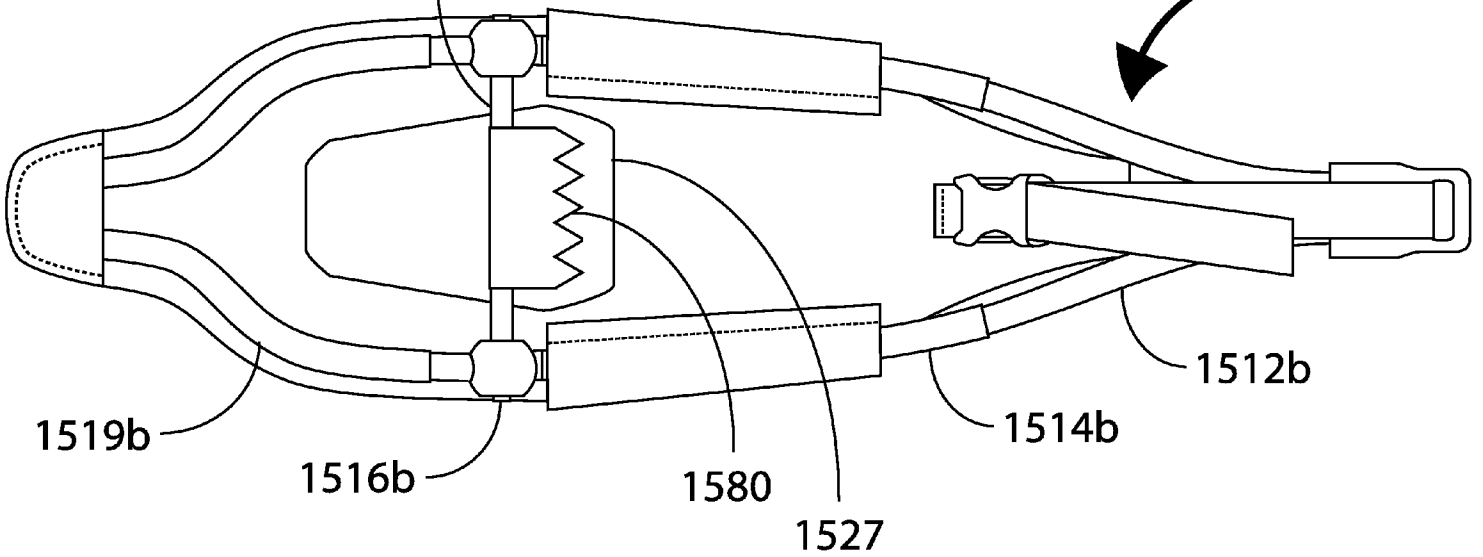
Figure 15B:
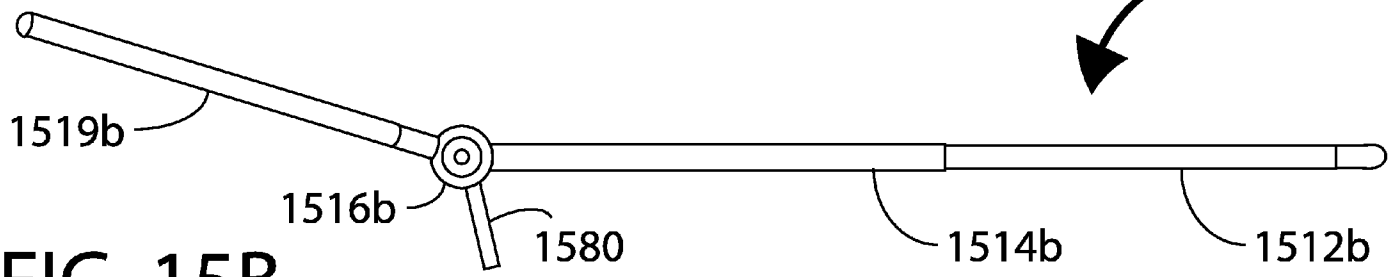

As shown in the top and side views of FIGS. 15A and 15B, snowshoe 1500 may include optional retractable crampon 1580 operatively coupled to center bar 1515. FIGS. 15A and 15B illustrate rotatable crampon 1580 secured in a retracted mode and a deployed mode, respectively.

Figure 10:
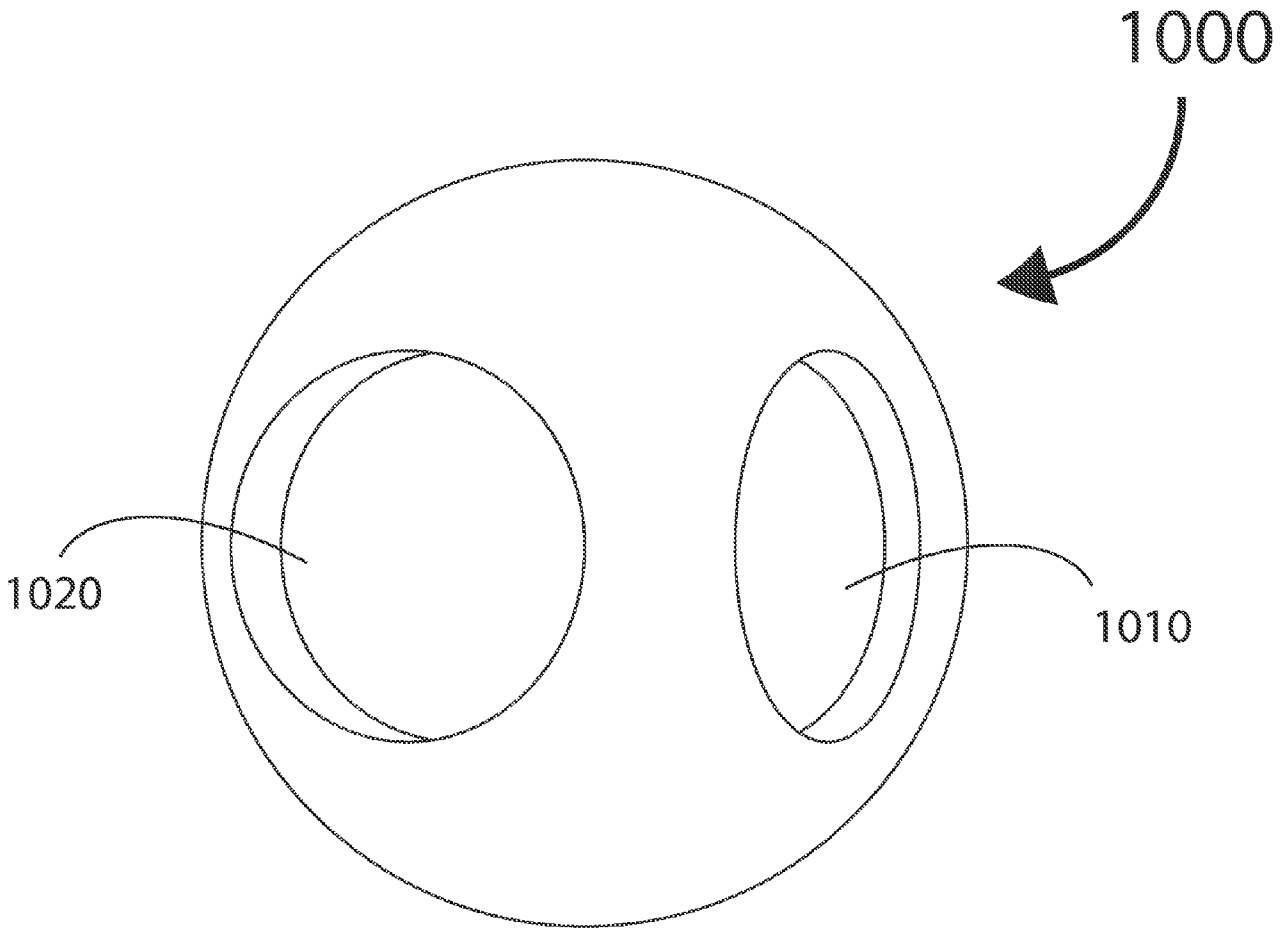
FIG. 10 illustrates an alternate joint profile for the snowshoe embodiment of FIG. 1A.

In the above described exemplary embodiments, the joints, e.g., joint 216*a* & 216*b* can include openings configured to retain exemplary bars and bar sections, e.g., bars 219*a*, 219*b* & 215 and bar sections 214*a* & 214*b*. Accordingly, in some embodiments, joints of frames, e.g., frame 110, may include circular and/or non-circular recesses configured to retain a portable chair cross member (see exemplary joint 1000 of FIG. 10). Non-circular recesses enhance stability by reducing twisting motions between the respective joint and cross member in the assembled state. Many non-circular recess profiles are possible, such as elliptical, polygonal (including quadrilaterals such as rectangular, rhombus, trapezoid), and triangular. Hence, exemplary twist-resistant joint geometries for joints for snowshoe frames include ovals (e.g., joint 1000), hexagons, D-shapes, triangles, rectangles and squares.

Further, frames for snowshoes can be secured to their respective webbings using suitable alternate mechanisms, for example, using hook and loop interfaces instead of stitched sleeves. In addition, selected portions of webbings, e.g. webbing 120, can be substantially contiguous and/or substantially perforated.

While this invention has been described in terms of several embodiments, there are alterations, modifications, permutations, and substitute equivalents, which fall within the scope of this invention. Although sub-section titles have been provided to aid in the description of the invention, these titles are merely illustrative and are not intended to limit the scope of the present invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A collapsible snowshoe useful in association with a footwear, the collapsible snowshoe comprising:

a collapsible snowshoe frame including:

a first pair of bars, each of the first pair of bars having a first end and a second end, wherein the second ends of the first pair of bars are not connected to each other;

a second pair of bars that are each collapsible and include at least two bar sections that are configured to be removably coupled to each other, each of the second pair of bars having a first end and a second end, wherein the second ends of the send pair of bars are not connected to each other;

a pair of joints, each of the pair of joints configured to be coupled to the corresponding first end of each of the first pair of bars, and further configured to be coupled to the corresponding first end of each of the second pair of bars; and a center bar configured to securely couple the pair of joints to each other; and a webbing including:

a front frame interface configured to accommodate the second ends of the first pair of bars; and a rear frame interface configured to accommodate the second ends of the second pair of bars.

2. The snowshoe of claim 1 further comprising a binding configured to secure a footwear to the snowshoe.

3. The snowshoe of claim 1 wherein the rear frame interface includes at least one pocket.

4. The snowshoe of claim 1 wherein the front frame interface includes one pocket, and wherein the first pair of bars are configured to converge toward each other and to be inserted into the one pocket.

5. The snowshoe of claim 3 wherein the front frame interface includes a pair of pockets, and wherein each of the first pair of bars are configured to be inserted into a corresponding one of the pair of pockets.

6. The snowshoe of claim 3 wherein the at least one pocket is formed by stitching.

7. The snowshoe of claim 3 wherein the at least one pocket includes at least one rigid material.

8. The snowshoe of claim 7 wherein the at least one rigid material includes at least one of a plastic material, a metallic material, a natural laminate and a synthetic laminate.

9. The snowshoe of claim 1 wherein the corresponding first end of first pair of bars and the corresponding first end of the second pair of bars are removably coupled to a corresponding one of the pair of joints via a corresponding elastic cord.

10. The snowshoe of claim 1 wherein the webbing further includes a strap and a fastener configured to secure the webbing to the frame.

11. The snowshoe of claim 10 wherein the fastener is a buckle set.

12. The snowshoe of claim 10 wherein the strap is non-elastic.

13. The snowshoe of claim 10 wherein the strap is elastic.

14. The snowshoe of claim 1 wherein the second ends of the first pair of bars are configured to be coupled to each other.

15. The snowshoe of claim 14 wherein the second ends of the front pair of bars are hinged to each other.

16. The snowshoe of claim 1 wherein the center bar includes a retractable crampon configured to be deployed by rotating approximately 90 degrees from a substantially horizontal angle relative to the frame.

17. The snowshoe of claim 1 wherein the front frame interface includes at least one pocket.

* * * * *